US009431183B2

(12) United States Patent
Colonna et al.

(10) Patent No.: US 9,431,183 B2
(45) Date of Patent: Aug. 30, 2016

(54) PLUNGER SWITCH ASSEMBLY AND METHOD OF OPERATION

(71) Applicant: Delta Systems, Inc., Streetsboro, OH (US)

(72) Inventors: Pat J. Colonna, Canfield, OH (US); Michael P. Haessly, Avon, OH (US)

(73) Assignee: Delta Systems, Inc., Streetsboro, OH (US)

( * ) Notice: Subject to any disclaimer, the term of this patent is extended or adjusted under 35 U.S.C. 154(b) by 68 days.

(21) Appl. No.: 14/324,462

(22) Filed: Jul. 7, 2014

(65) Prior Publication Data

US 2016/0005553 A1 Jan. 7, 2016

(51) Int. Cl.

| | |
|---|---|
| ***H01H 13/14*** | (2006.01) |
| ***H01H 3/12*** | (2006.01) |
| ***H01H 1/36*** | (2006.01) |
| ***H01H 1/44*** | (2006.01) |
| ***H01H 13/18*** | (2006.01) |
| *H01H 13/04* | (2006.01) |
| *H01H 13/06* | (2006.01) |

(52) U.S. Cl.

CPC ..... *H01H 3/12* (2013.01); *H01H 1/365* (2013.01); *H01H 1/44* (2013.01); *H01H 13/18* (2013.01); *H01H 13/04* (2013.01); *H01H 13/06* (2013.01)

(58) Field of Classification Search

CPC ..... H01H 13/12; H01H 3/166; H01H 13/28
USPC ..... 200/16 B, 531, 61.76, 16 D, 530, 532, 200/249, 284

See application file for complete search history.

(56) References Cited

U.S. PATENT DOCUMENTS

| | | | | |
|---|---|---|---|---|
| 4,045,637 | A * | 8/1977 | Mongeau | H01H 21/04 200/11 R |
| 4,369,745 | A | 1/1983 | Howard | |
| 4,795,865 | A | 1/1989 | Howard | |
| 4,812,604 | A | 3/1989 | Howard | |
| 4,839,478 | A | 6/1989 | Howard | |
| 4,894,019 | A | 1/1990 | Howard | |
| 4,924,046 | A | 5/1990 | Howard | |
| 5,221,816 | A | 6/1993 | Williams | |
| 5,424,502 | A * | 6/1995 | Williams | H01H 3/141 200/61.76 |
| 5,528,007 | A | 6/1996 | Williams et al. | |
| 5,548,888 | A | 8/1996 | Williams | |
| 5,613,598 | A | 3/1997 | Pittman et al. | |
| 5,756,947 | A | 5/1998 | Trimble, Jr. et al. | |
| 5,775,482 | A | 7/1998 | Wolfe et al. | |
| 6,207,910 | B1 | 3/2001 | Harvey et al. | |
| 6,457,545 | B1 | 10/2002 | Michaud et al. | |
| 6,483,061 | B1 * | 11/2002 | Harvey | H01H 13/12 200/16 B |
| D472,883 | S | 4/2003 | Harvey | |
| 6,543,560 | B1 | 4/2003 | Trefz et al. | |
| 6,618,022 | B2 | 9/2003 | Harvey | |
| 6,648,092 | B2 | 11/2003 | Michaud et al. | |
| D500,744 | S | 1/2005 | Michaud | |
| 6,868,925 | B2 | 3/2005 | Trefz et al. | |

(Continued)

*Primary Examiner* — Edwin A. Leon
*Assistant Examiner* — Ahmed Saeed
(74) *Attorney, Agent, or Firm* — Tarolli, Sundheim, Covell & Tummino, LLP

(57) ABSTRACT

A switch assembly and method of operation comprises a housing for supporting a plunger arrangement for moveable positioning of a plunger relative to the housing and plunger arrangement. The plunger arrangement comprises a retainer support for fixedly holding at least one terminal member within a retainer groove having a transverse channel passing from a first end to a second end of the retainer support.

21 Claims, 27 Drawing Sheets

(56) References Cited

U.S. PATENT DOCUMENTS

| | | | |
|---|---|---|---|
| 7,064,639 | B2 | 6/2006 | Harvey et al. |
| 7,168,519 | B2 | 1/2007 | Harvey et al. |
| D558,155 | S | 12/2007 | Michaud et al. |
| 7,488,914 | B2 | 2/2009 | Kahnert et al. |
| D597,962 | S | 8/2009 | Albrecht |
| 7,629,543 | B2 | 12/2009 | Kahnert |
| 7,812,473 | B2 | 10/2010 | Larsen et al. |
| 8,256,197 | B2 | 9/2012 | Kahnert |
| 8,921,724 | B2 | 12/2014 | Young |
| 9,053,877 | B2 | 6/2015 | Young |
| 2014/0104796 | A1 | 4/2014 | Nohra et al. |
| 2014/0332357 | A1 | 11/2014 | Kirbawy |

* cited by examiner

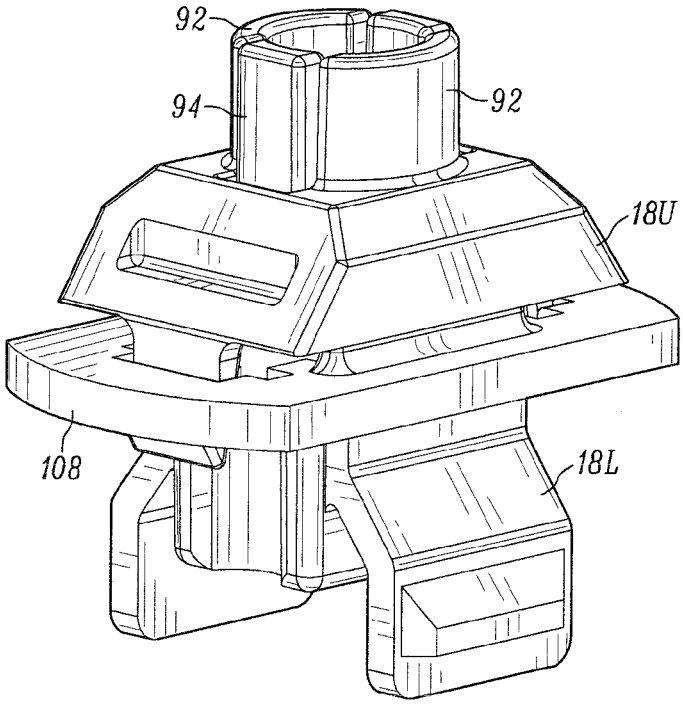
FIG. 40
FIG. 41
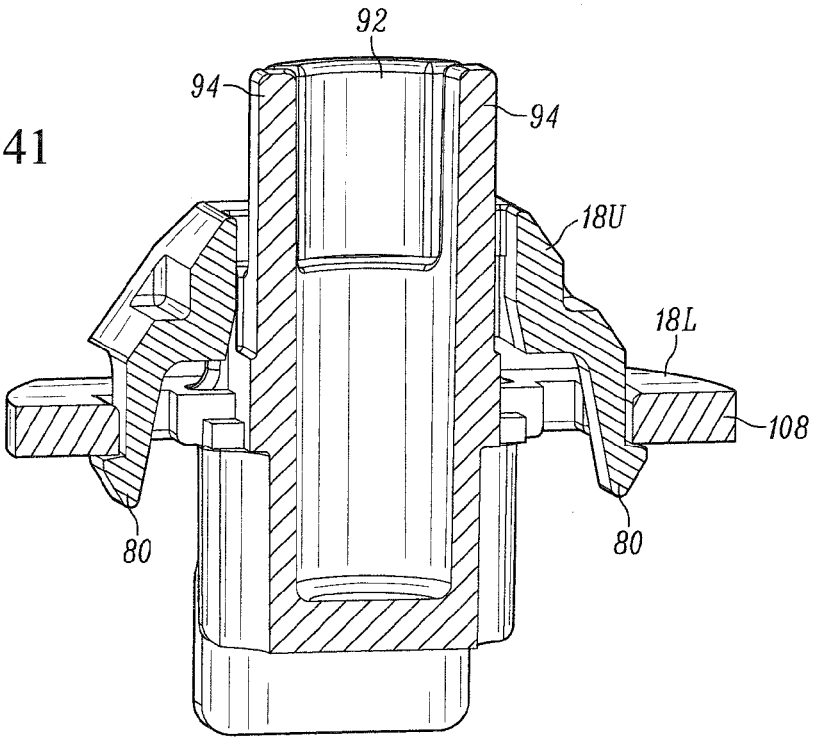

PLUNGER SWITCH ASSEMBLY AND METHOD OF OPERATION

FIELD OF THIS DISCLOSURE

The present disclosure relates to a plunger switch assembly and method of operation and more specifically, a plunger switch assembly and method of operation for use in connection with power equipment.

BACKGROUND

Electrical switches using push button or plunger type switch actuators have many applications including use in automobile car doors, ignition circuits, power take-offs for lawn mowers and garden tractors, refrigerator doors, home appliances, and the like, hereinafter "power equipment". These push buttons may be normally open, normally closed or a combination of the two.

It is possible to construct switches having two or more terminals, which combine the features of normally open and normally closed switches. For example, a "double-pole double-throw" switch behaves as a normally open switch and a normally closed switch in parallel operated by a single plunger. When the plunger is in a normal position, a pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Plunger switches are suitable for numerous objectives when used with power equipment. Such objectives include, but are not limited to, safety tether switch, boat trim switch, boat throttle neutral switch, off-road utility brake light switch, back-up light switch, E-stop switch, power take off enable/disable switch, and sense position switches.

Further discussion relating to the different switch constructions can be found in U.S. Pat. No. 5,528,007 entitled PLUNGER SWITCH AND METHOD OF MANUFACTURE that issued on Jun. 18, 1996 and assigned to the assignee of the present disclosure. U.S. Pat. No. 5,528,007 is incorporated herein by reference in its entirety.

SUMMARY

One aspect of the present disclosure comprises a switch assembly and method of operation, the switch assembly having a housing for supporting a plunger arrangement for moveable positioning of a plunger relative to the housing and plunger arrangement. The plunger arrangement comprises a retainer support for fixedly holding at least one terminal member within a retainer groove having a transverse channel passing from a first end to a second end of the retainer support.

Another aspect of the present disclosure comprises a switch assembly having a housing with a longitudinal axis for supporting a plunger arrangement for moveable positioning of a plunger relative to the housing and plunger arrangement along the longitudinal axis. The plunger arrangement comprising a two-piece retainer support having an upper retainer support and lower retainer support, the upper and lower retainer support for fixedly holding at least one terminal member within a nesting pocket collectively formed by the upper and lower retainer supports.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which:

FIG. 40 is a perspective assembly view of a retainer assembly constructed in accordance with one example embodiment of the present disclosure;

FIG. 41 is a sectioned elevation view of FIG. 40;

Figure 1:
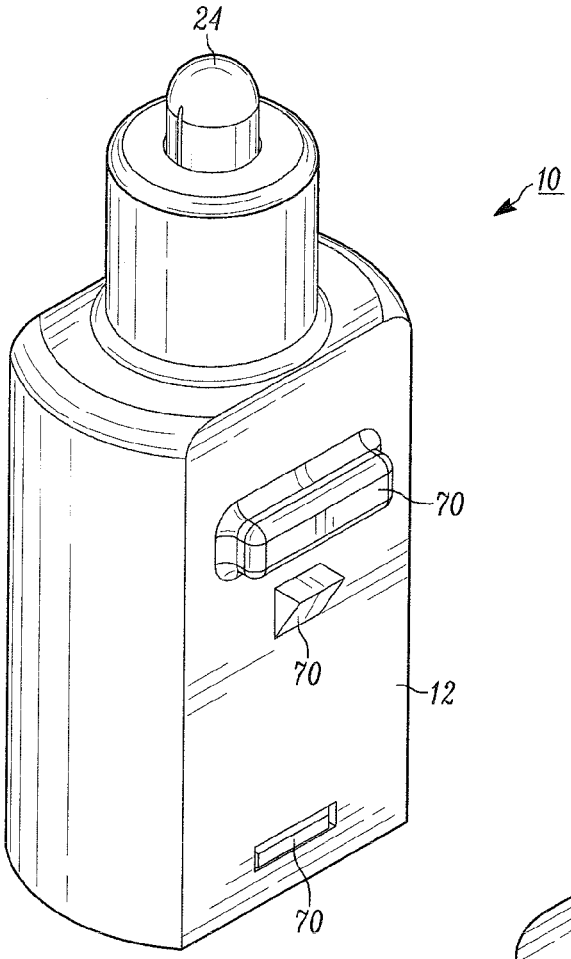
FIG. 1 is a first perspective view of switch assembly constructed in accordance with one example embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a plunger switch assembly and method of operation and more specifically, a plunger switch assembly and method of operation for use in connection with power equipment.

Illustrated in FIGS. 1-8 is a switch assembly 10 constructed in accordance with one example embodiment of the present disclosure. The switch assembly 10 comprises a housing 12, plunger arrangement 14 (see FIG. 9), plunger 16, retainer support 18, and one or more terminal members 20.

The housing 12 protects the internal components of the switch assembly 10 from the environment. In the illustrated example embodiment, the housing 12 is formed from molded plastic. The housing 12 further provides mounting features not only for the plunger 16 and plunger arrangement 14, but other internal components and external components, such as a wiring harness 6. The wiring harness 6 communicates with an electronic control unit (ECU) 8 for the operation of the power equipment 5. In an alternative example embodiment, the wiring harness 6 communicates directly to the power equipment, or more specifically, the engine or other components in which the switch assembly is coupled.

The housing 12 further provides a sealing/sliding surface 21 for o-rings 22 found on the plunger 16. The o-rings or seals 22 provide an environmental seal with the housing 12 to prevent contaminates or debris from entering an opening 26 of the housing. The housing 12 also provides a well area 27 (see FIG. 2) to pour a two-part epoxy to provide an environmental seal near the wiring harness attachment.

Figure 9:
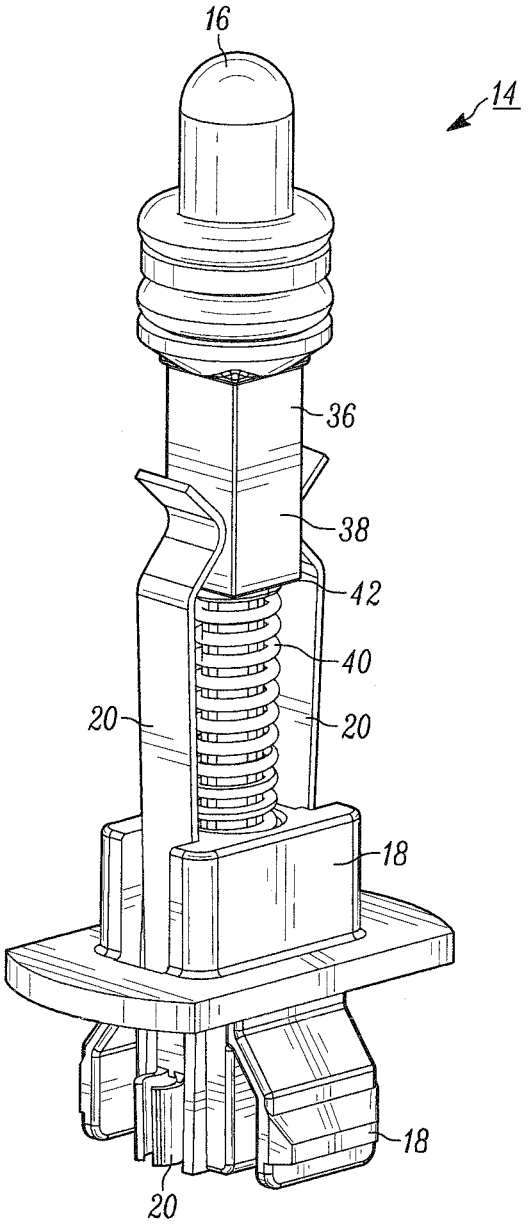
FIG. 9 is a plunger arrangement of the switch assembly constructed in accordance with one example embodiment of the present disclosure.
Figure 10A:
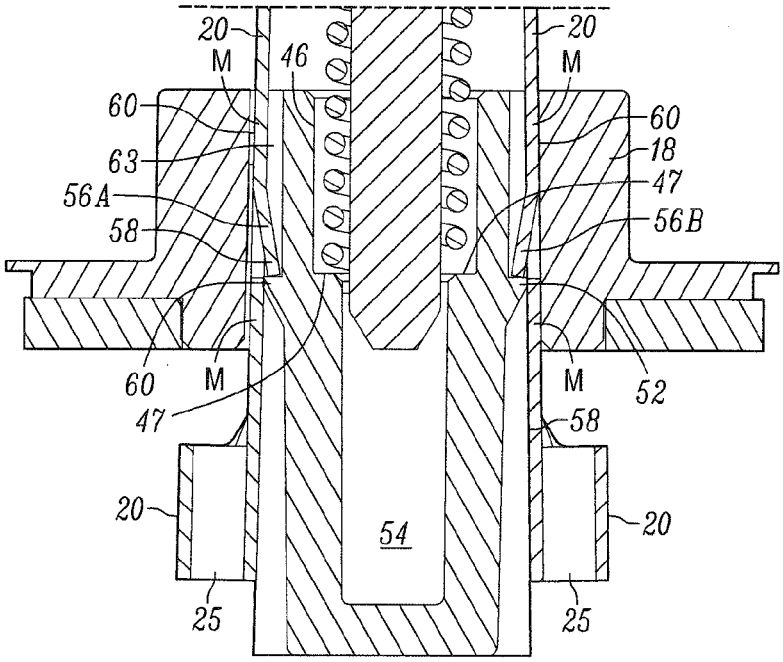
FIG. 10A is a cross-sectional view of a portion of the switch assembly along section lines 10-10 of FIG. 7 constructed in accordance with another example embodiment of the present disclosure.

The plunger 16 includes a head 24 that projects from the opening 26 in the housing 12. The plunger 16, and more particularly the plunger arrangement 14 as illustrated in FIG. 9 is supported by the housing 12, while the plunger is moveably located about the housing and plunger arrangement. The head 24 when exposed to an external force, causes the plunger 16 to translate within the housing 12, resulting in the activation or communication of the switch to the ECU of the power equipment or directly to the power equipment or components thereof.

Figure 12:
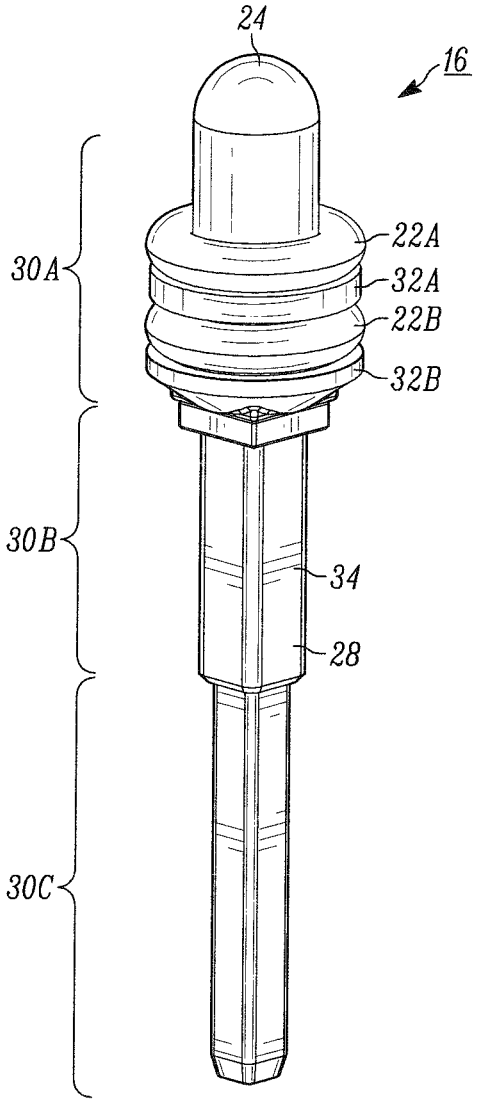
FIG. 12 is a plunger of the switch assembly constructed in accordance with one example embodiment of the present disclosure.
Figure 20:
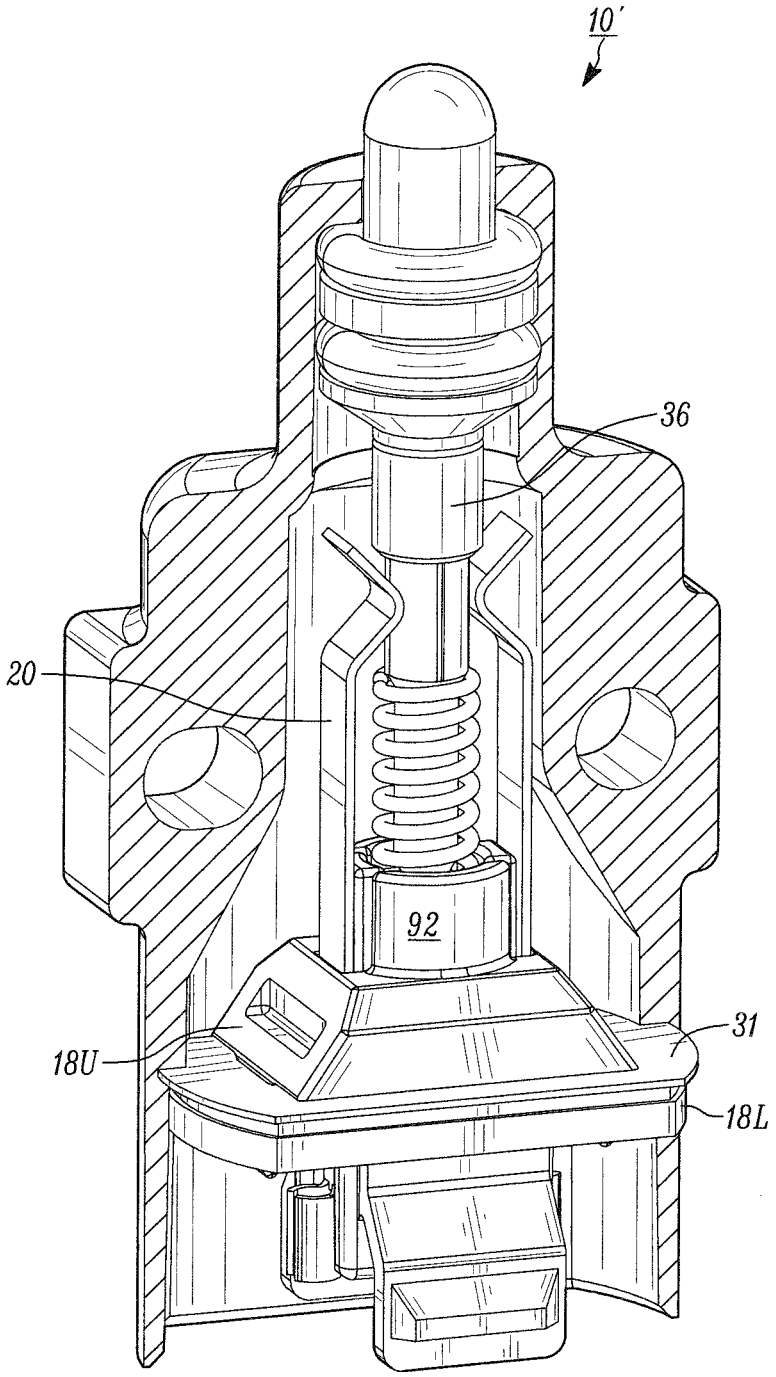
FIG. 20 is an internal perspective section-view of a housing of the switch assembly of FIG. 18.
Figure 21:
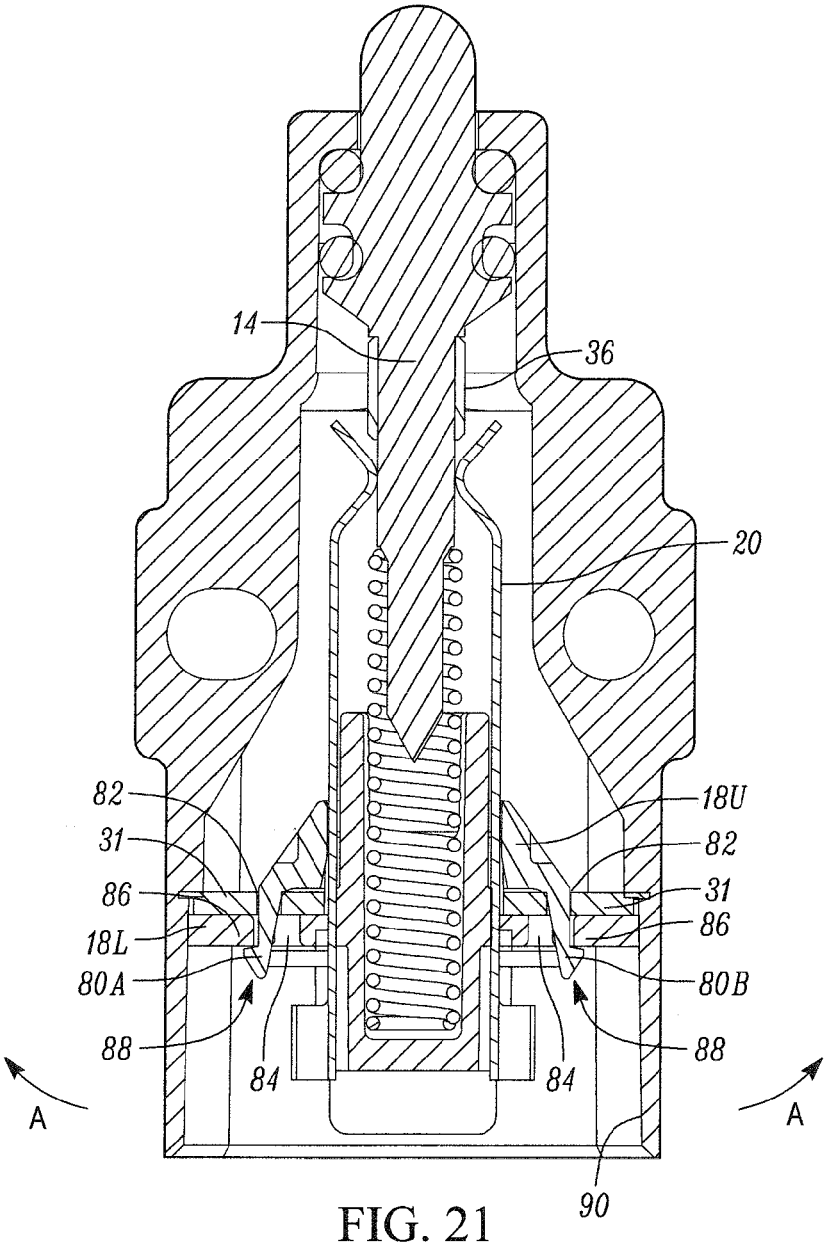
FIG. 21 is a front elevation section-view of housing the switch assembly of FIG. 18 along section lines 20-20.

The plunger 16 includes a body 28 having an upper portion 30A, a medial portion 30B, and a lower portion 30C, as seen in FIG. 12. The upper portion 30A includes the head 24 and first and second projections 32A, 32B, respectively that support upper and lower seals 22A and 22B. The projections 32A and 32B extend from and are molded into the plunger 16. The body 28 comprises a contacting ring 36 that conducts electricity and/or closes a circuit or switch and an insulating ring 38 that insulates the passage of electricity or breaks a circuit. In one example embodiment, the rings 36 and 38 are square (see FIG. 9) or circular (see FIG. 20) or any combination of square or circular and further it should be appreciated that the insulating ring 38 can be positioned above or below the contacting ring 36 without departing from the spirit or scope of the present disclosure.

Figure 11:
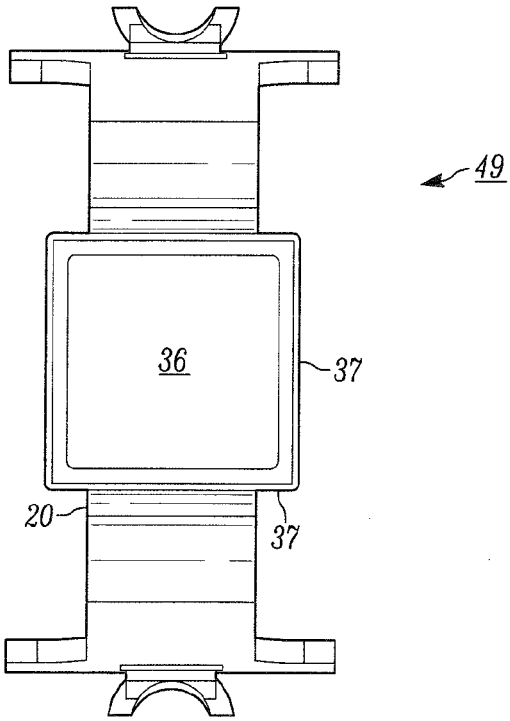
FIG. 11 is a contact fixture of the switch assembly constructed in accordance with another example embodiment of the present disclosure.
Figure 10B:
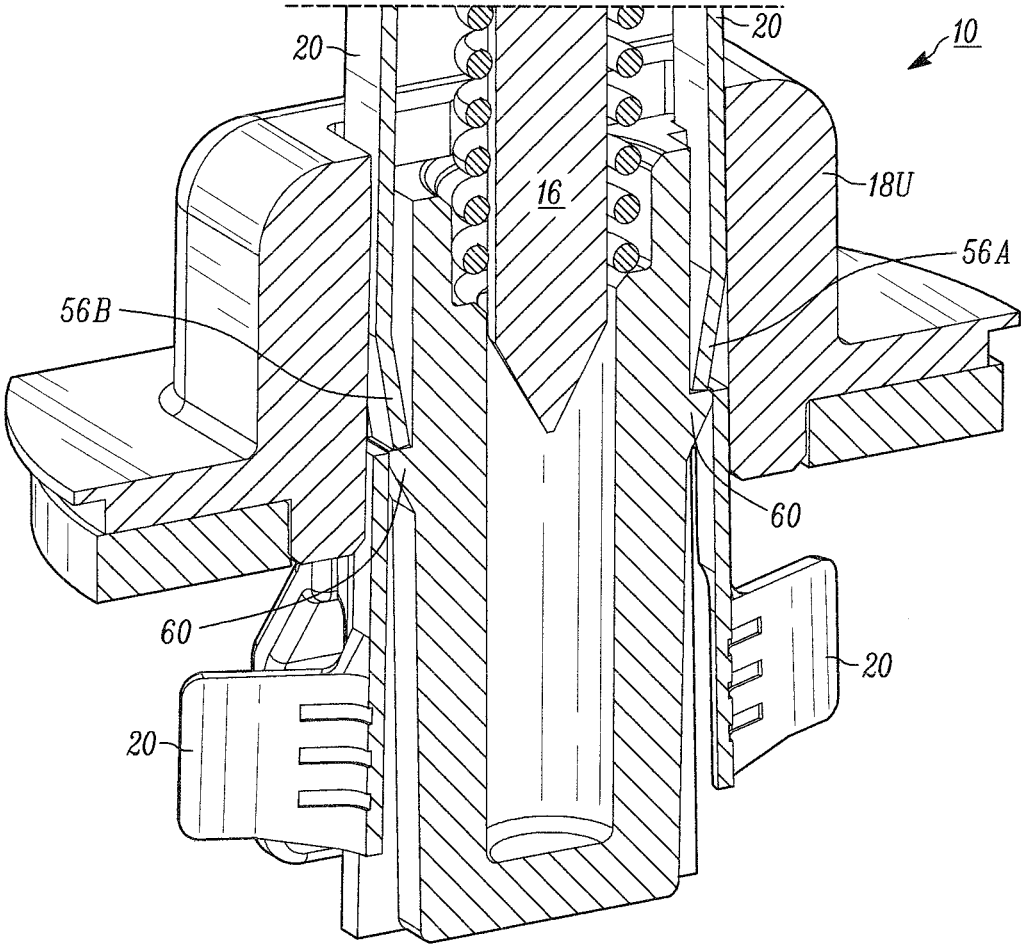
FIG. 10B is a perspective sectional view of FIG. 10A.
Figure 10C:
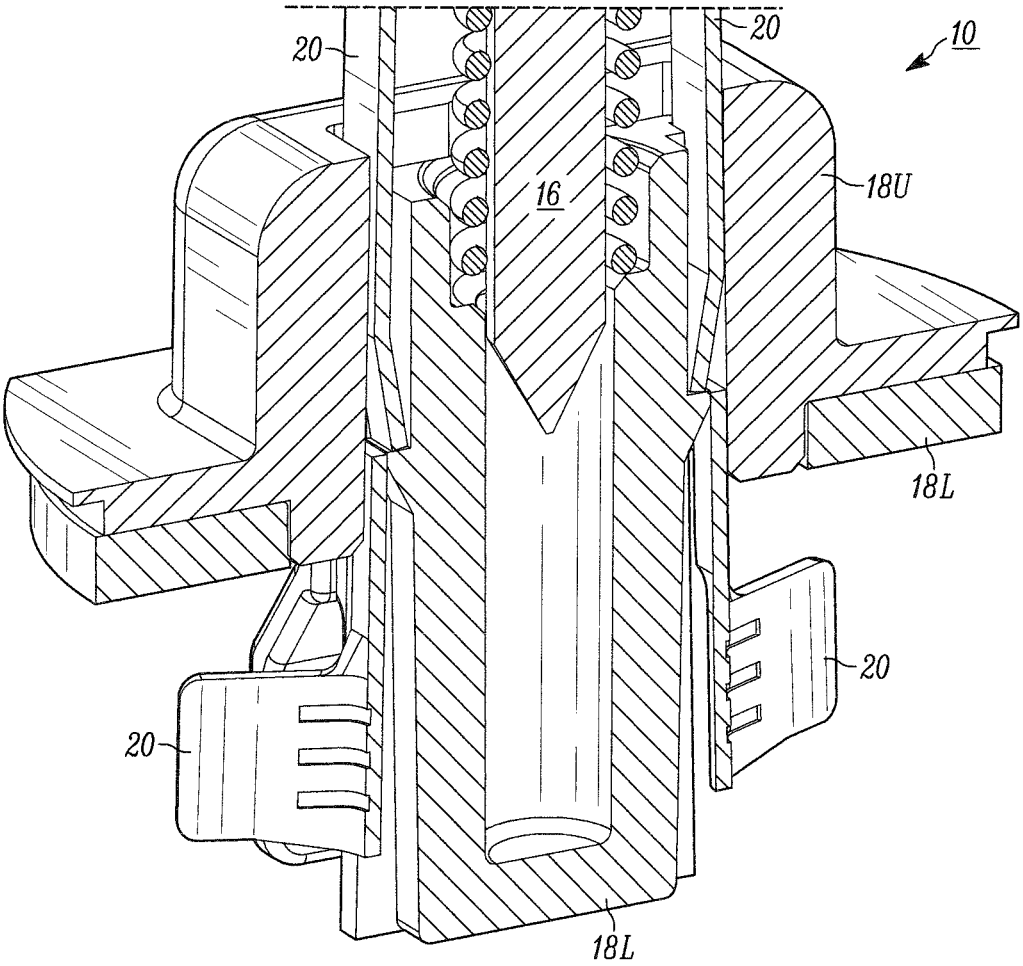
FIG. 10C is another perspective view of FIG. 10A.

FIG. 11 illustrates is a contact fixture 49 of the switch assembly 10 constructed in accordance with another example embodiment of the present disclosure. The contact fixture 49 is a top plan view illustrating the terminals 20, contact ring 36, and its respective planar surfaces 37. The planar surfaces 37 of the contact ring 36 allow more surface contact between the terminals 20 and contact ring. As a result, the voltage drop contract ring 36 is advantageously reduced.

In the illustrated example embodiment, the contact ring 36 includes the planar surfaces 37, as further shown in FIGS.

Figure 16:
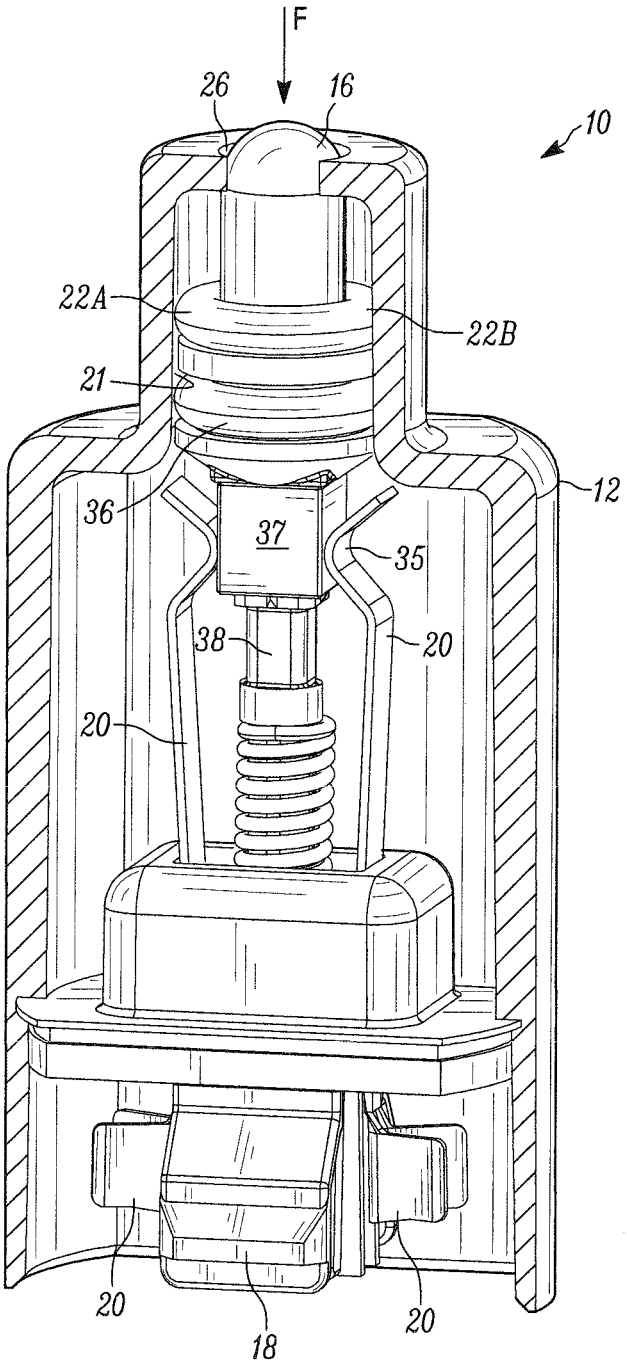
FIG. 16 is a perspective section view of FIG. 7 wherein the plunger is moveably located to a second position.
Figure 17A:
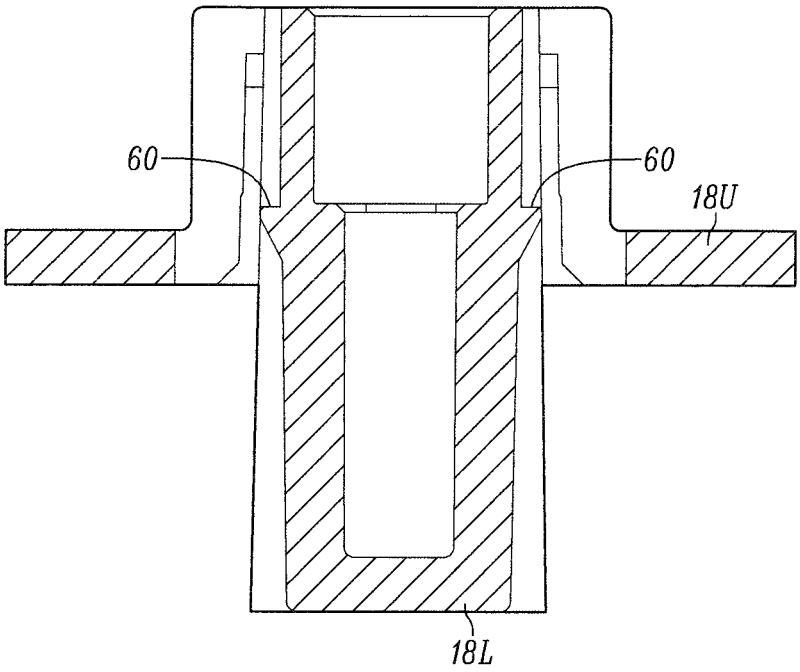
FIG. 17A is a section elevation view of a retainer support along section lines 17-17 in FIG. 13 in accordance with one example embodiment of the present disclosure.
Figure 17B:
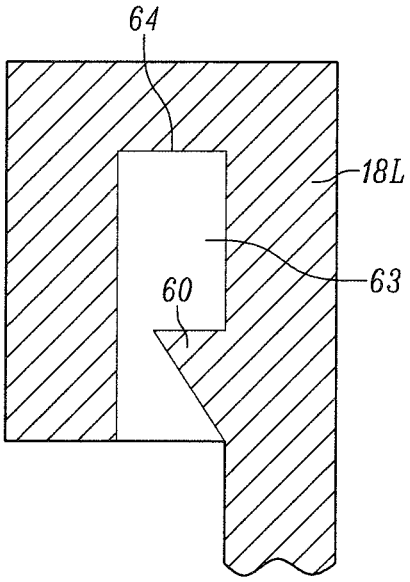
FIG. 17B is a magnified portion of the section view of FIG. 17B.
Figure 18:
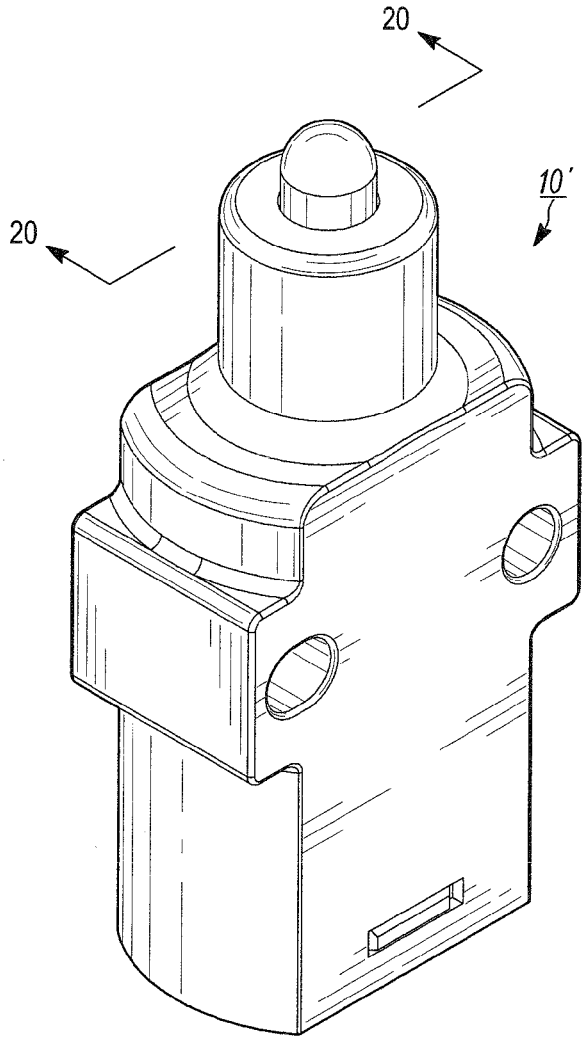
FIG. 18 is a first perspective view of switch assembly constructed in accordance with another example embodiment of the present disclosure.
Figure 19:
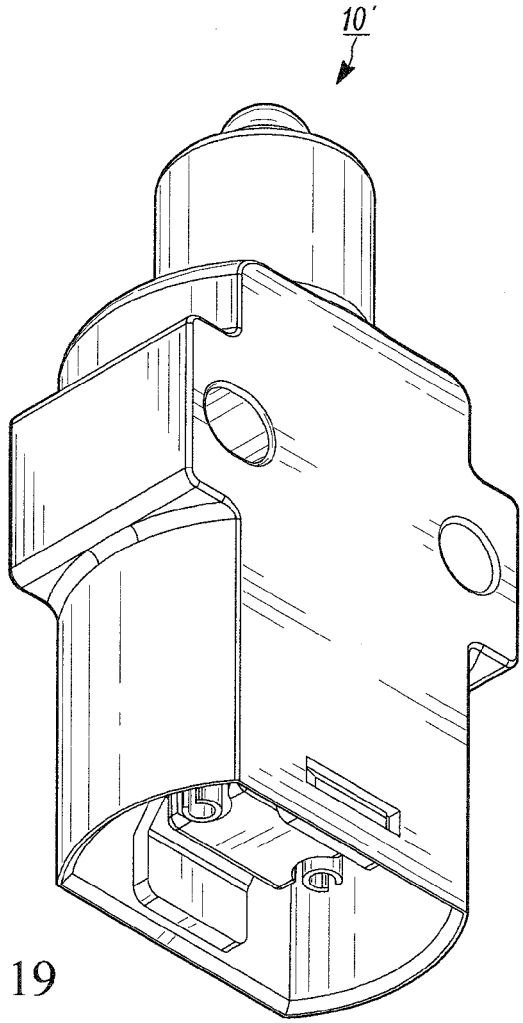
FIG. 19 is a second perspective view of the switch assembly of FIG. 18.

8, 9, 11 and 16. When a force F is applied to the head 24, the plunger 16 is advanced down into the opening 26 relative to the housing 12 and plunger arrangement 14, as illustrated in FIG. 16. The plunger 16 then passes from the insulating ring 38 or open air to one of the planar surfaces 37, thus allowing continuity by closing an electrical circuit and allowing the passage of electricity from the wiring harness 6, up terminal member 20*a* through contact ring 36 and down terminal member 20*b* into the wiring harness 6. In yet another example embodiment, the contact ring 36 and insulator ring 38 are reversed to create a normally closed switch that can be turned off when a force is applied to the plunger 16.

In the illustrated example embodiment, the housing 12 includes a number of projections or inclusions 70 molded as part of the housing. The projections or inclusions 70 allow for attachment to a mating panel of the power equipment (not shown). The power equipment may also have mounting holes, locking ramps, threaded features, or any combination thereof for the attachment of the switch assembly 10. The switch assembly 10 can be further attached with various fasteners, rivets, pins, and the like such that the switch assembly will not move or deflect during operation.

The design of the switch assembly 10 as described above fixedly attaches the terminal members 20 into the housing 12 such that the final location for all switch assemblies during construction are constant and repeatable within the housing. The design of the retainer support 18 and terminal members 20, and their respective interconnection eliminate movement of the terminals and position of the terminal wipers 35 upon the contact and insulating rings 36, 38, respectively. This is further illustrated as the plunger 16 is translated between a lowered or engaged position (see FIG. 16) and a raised or unengaged position (see FIG. 8).

A supporting surface 34 is formed in the body 28 that fixedly attaches in location as shown in FIG. 9 both the contact ring 36 and the insulating ring 38 onto the plunger 16. The contact ring 36 provides a surface between first and second terminals 20A and 20B, respectively, such that when in contact with a wiper portion 35 of the terminals closes a circuit in the ECU or electromechanical device 8 it allows electricity to conduct through the switch assembly 10. The insulating ring 38 provides a nonconductive surface between the first and second terminals 20A and 20B when in contact, thus opening the circuit formed by the ECU or electromechanical device 8 and prevents the flow of electricity through the switch assembly 10. The switch assembly 10 further provides a third or "open air" condition to prevent the flow of electricity. In this open air condition, when the contact ring 36 is not in contact with the terminals 20A, 20B. In the illustrated example embodiment, the contact ring 36 is made of metal such as copper, while the insulating ring is made of plastic.

Biasing the plunger 16 upward and against the stop surface 23 such that the plunger head 24 projects from the opening 26 is a spring member 40. The contact ring 36, insulating ring 38, and spring member 40 are all installed by passing the rings and spring in the prescribed order over and about the body 28 at the lower portion 30C until the contact ring 36 engages and is stopped by the lower projection 32B. The spring member 40 then engages at a first end 42 of the spring, as seen in FIG. 9 with the bottom of the insulating member 38, biasing the plunger 16 upward relative to the plunger arrangement 14 and housing 12 out its opening 26.

Figure 2:
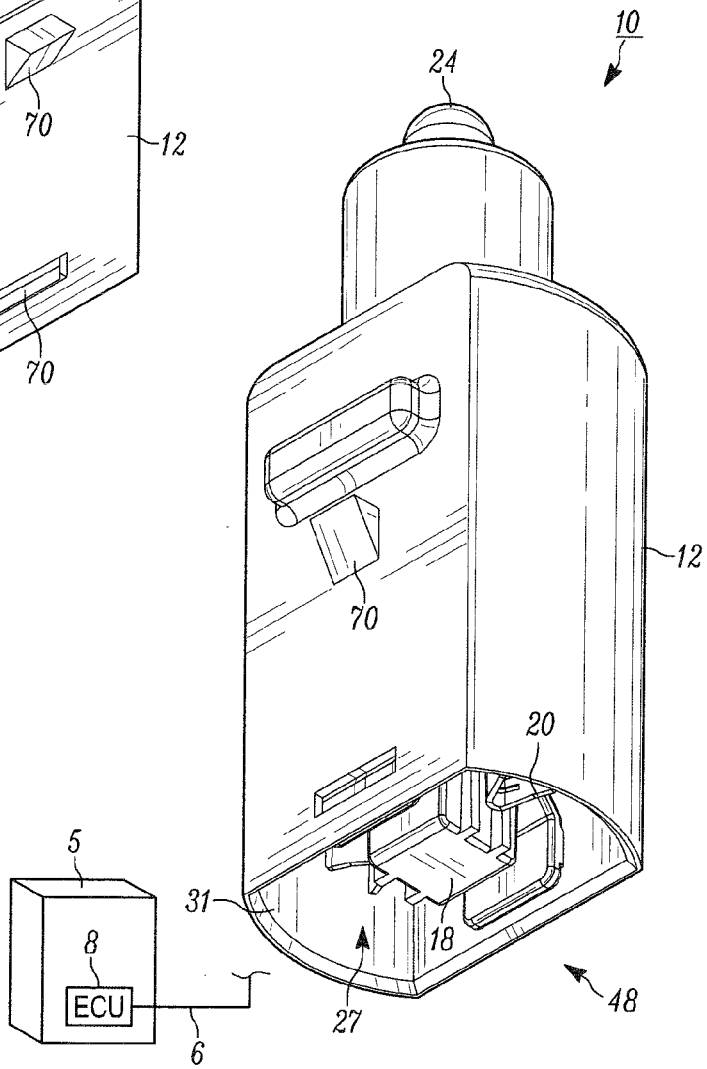
FIG. 2 is a second perspective view of FIG. 1.
Figure 3:
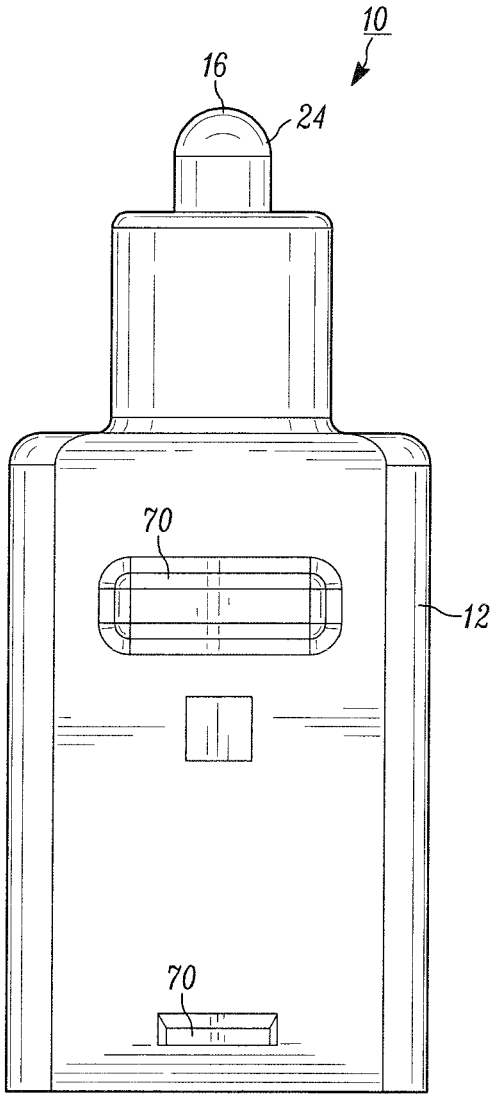
FIG. 3 is a front elevation view of FIG. 1.
Figure 4:
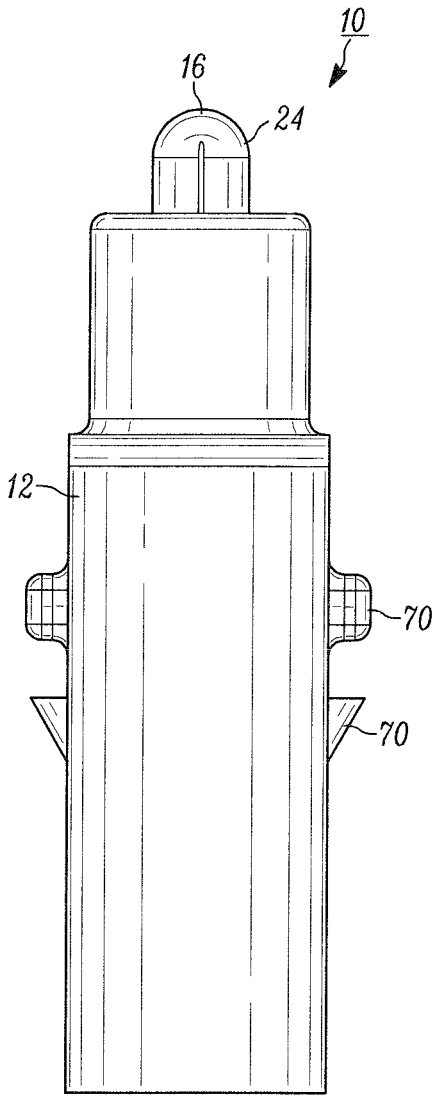
FIG. 4 is a side elevation view of FIG. 1.
Figure 5:
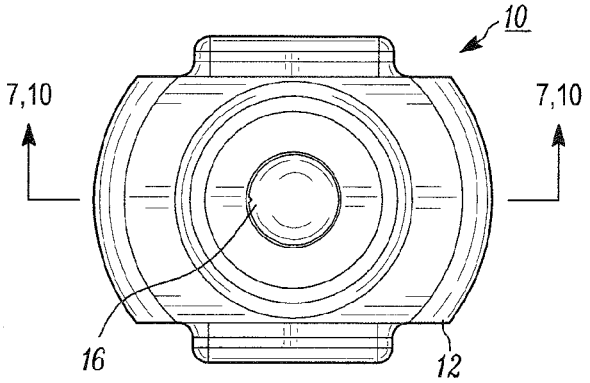
FIG. 5 is a top elevation view of FIG. 1.
Figure 6:
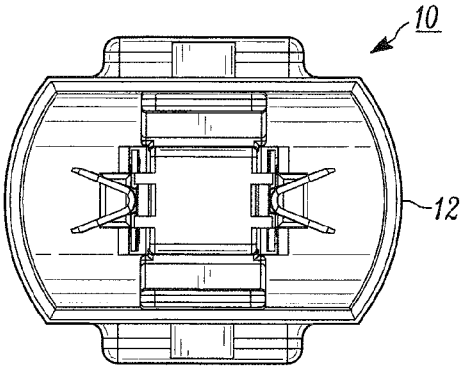
FIG. 6 is a bottom elevation view of FIG. 1.
Figure 7:
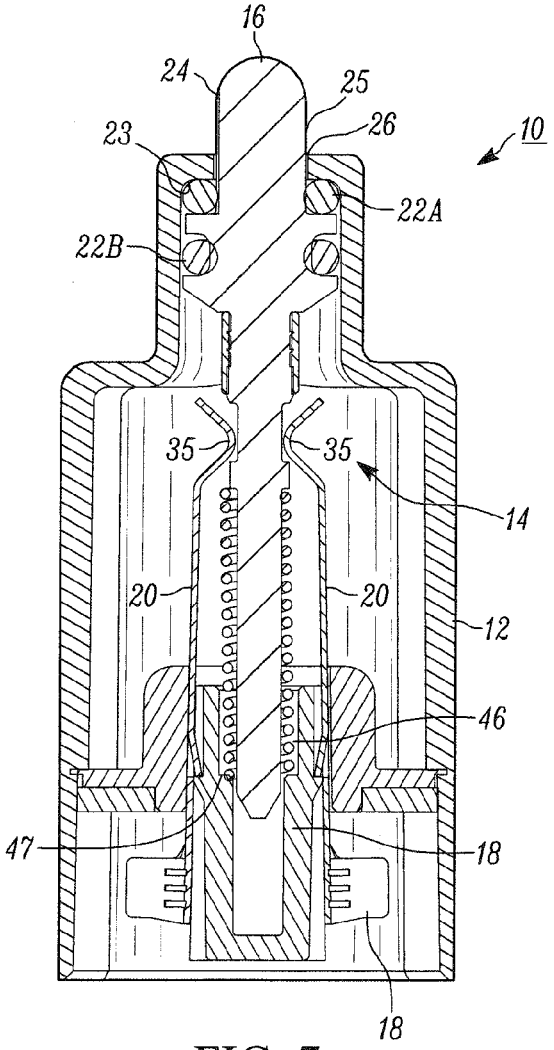
FIG. 7 is a section view of FIG. 5 about section lines 7-7.
Figure 8:
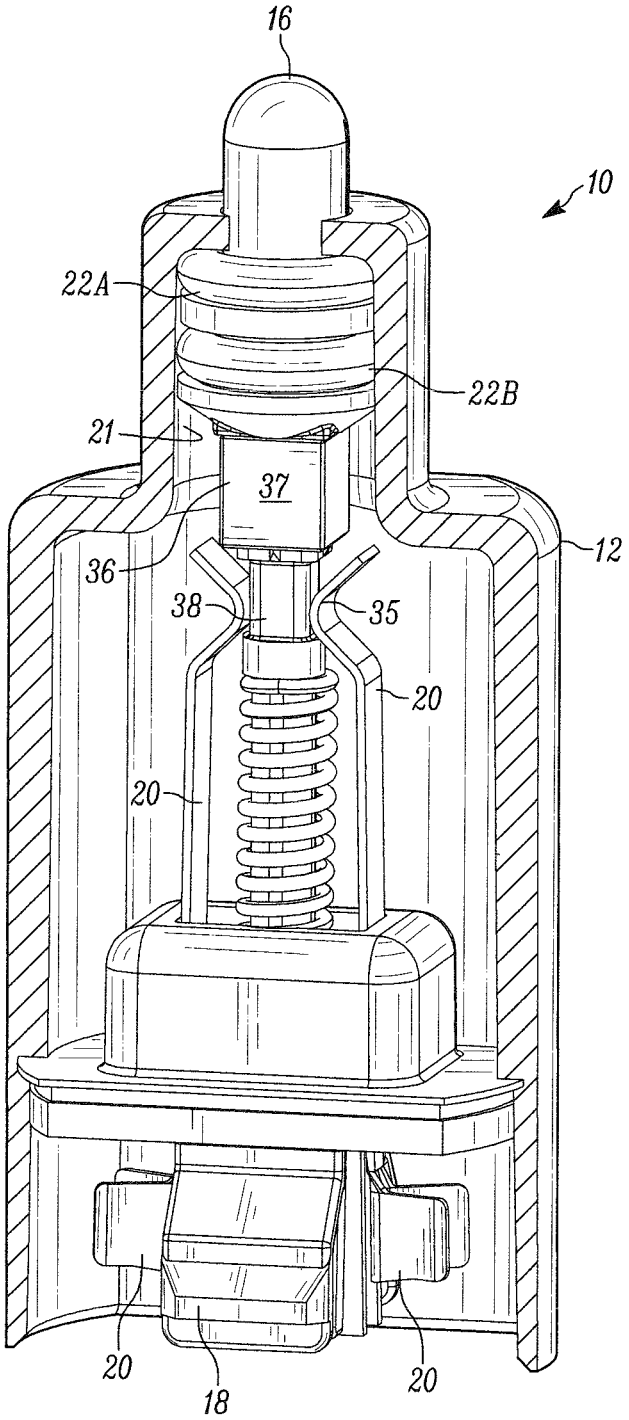
FIG. 8 is a perspective section view of FIG. 7, wherein the plunger is located in a first position.

The spring member 40 receives its support for biasing the plunger 16 toward the opening 26 at a second end 44 of the spring that is nested in a recess 46 of the retainer 18, as illustrated in FIGS. 7, 10A, 10B, and 10C and bottoms out on annular ridge 47. Once the spring member 40 is installed over and about the body 28, the retainer support 18 is press-fit into a bottom opening 48 of the housing 12, as illustrated in FIG. 2. Wire coupled or in communication with a wiring harness (not shown) is connected to the crimp rings 25 of the terminal members 20. The terminal members 20 are then positioned within the upper and lower portions of the retainer 18. Once the terminal members 20 are positioned in the retainer 18, the plunger arrangement is positioned within the housing 12.

In the illustrated example embodiment, the plunger 16 and retainer support 18 are made from molded plastic and the rings 36, 38, and spring member 40 include a central opening 26 for the inner passing of the body 28 during assembly. The retainer support 18 advantageously maintains alignment with the internal plunger arrangement 14, preventing buckling of the spring member 40 or side load movement of the contact ring. Both of such advantages increase the reliability, quality, and life of the switch assembly 10.

A further advantage of the retainer support 18 is its upper 18U and lower 18L retainers its construction for supporting terminal members 20. In particular, the terminal members 20 are fixedly located within the retainer support 18 via lock tang members 56A and 56B in FIGS. 10A, 10B and 10C on the terminal members and corresponding shelf members 60 see FIGS. 10A, 10B, 10C, and 17A-17B of the retainer support 18, and in particular the lower retainer support 18L. The shelf members 60 provides a ramp for the terminals lock tangs 56A and 56B. Once the terminals 20 reach the correct height imposed by a positive stop in the retainer 18, the lock tangs 56 spring into a region of lower retainer 18L above the shelf members 60, locking the terminals against the retainer. This locking connection between shelf members 60 and lock tangs 56 allows for more reliable alignment of the terminal members 20 with the conductive and insulating rings 36, 38, thus a better quality switch assembly 10.

The retainer support 18 comprises in addition a recess 46, a port 54 as illustrated in FIG. 10, which collectively entrap the end of the plunger 16, guiding and stabilizing the plunger against side load issues. The recess 46 further provides a surface for the spring member to push against when the plunger 16 is activated.

Figure 13:
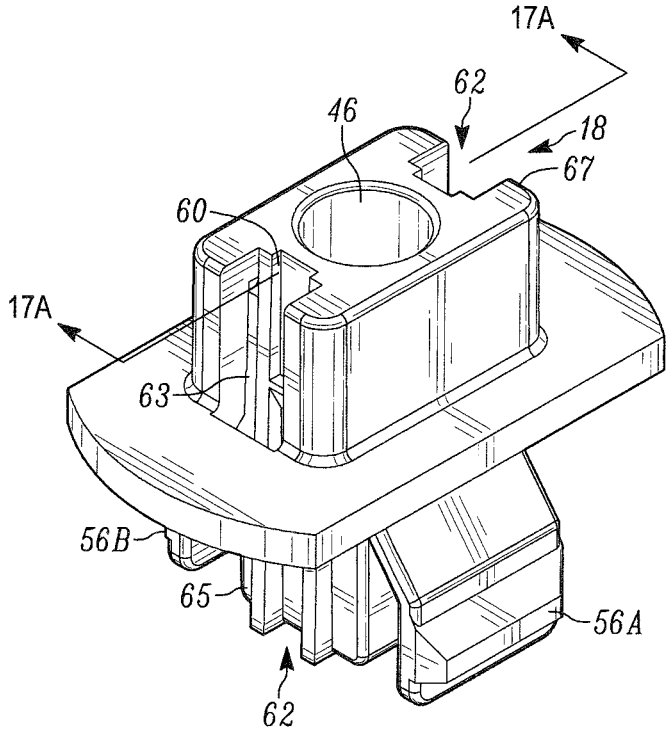
FIG. 13 is a retainer body constructed in accordance with one example embodiment of the present disclosure.
Figure 14:
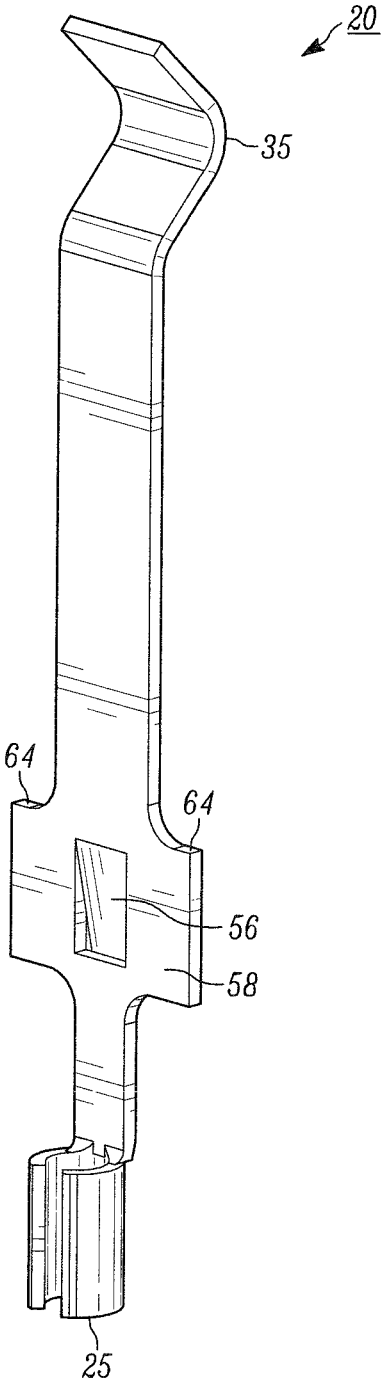
FIG. 14 is a terminal member constructed in accordance with one example embodiment of the present disclosure.
Figure 15:
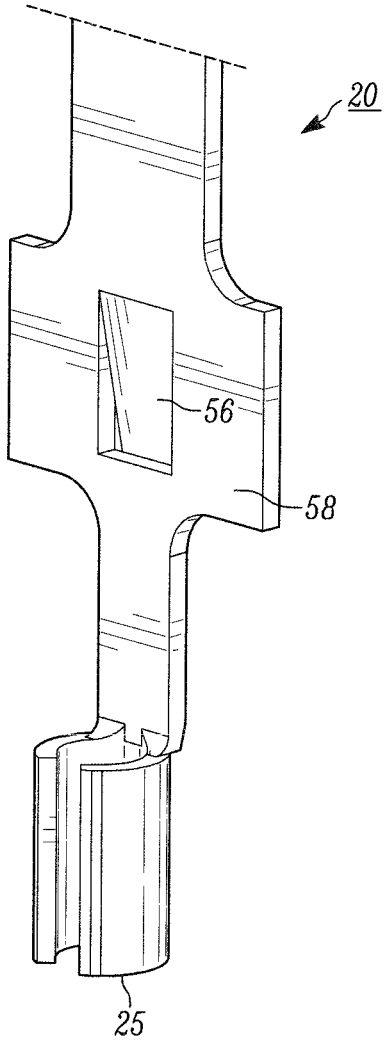
FIG. 15 is a magnified partial view of the terminal member of FIG. 14.

The terminal members 20 conduct the flow of electricity when the switch assembly 10 is in a closed circuit state. As illustrated in FIGS. 13, 14, and 15, the terminal member includes a locking arm or tang 56, projecting outward from a relatively planar body 58 of the terminal. The locking arms 56 hold the terminals in place against a ramp 60 located on the retainer support. The ramp 60, molded into the retainer support 18 keeps the terminal members 20 from backing out of the retainer once fully seated into retainer grooves 62 located in the retainer support. In the illustrated example embodiment, the retainer grooves 62 are non-linear through the retainer 18 having transverse channels 63 in the grooves for supporting and fixedly holding the terminal members 20 therein from a first end 65 to a second end 67 of the retainer support.

The terminal members 20 further include a positive stop 64 surface to position repeatably and consistently the height and alignment of the terminal when positioned in the retainer support 18. The contacts or crimp rings 25 are used to mechanically hold onto the wires of the wiring harness 6. The contacts 25 are the electrical interface for the wires and terminals.

Two Piece Retainer Assembly

In an alternative example embodiment, a switch assembly 10 comprises terminal members 20 that are located in the retainer support 18 through a support channel 96 formed by an upper and a lower two-piece retainer 18U and 18L, respectively, as illustrated in FIGS. 18-45. The channel support 96 advantageously maintains alignment with the internal plunger arrangement 14, preventing buckling of the spring member 40 or side load movement of the contact ring. Both of such advantages increase the reliability, quality, and life of the switch assembly 10. The retainer support 18 and channel support 96 allow for the terminal members 20 to positively nest/hold the terminal members into the required position against the retainer and relative location on the plunger 16.

The terminal members 20 nest/hold concept of the example embodiments illustrated in FIGS. 18-45, also allow for the use of two retainers 18U and 18L to be used to maintain correct terminal member 20 positions within the retainer(s). This design does not require the use of a lock tang members 56 on the terminal 20 illustrated in the previous embodiments. The upper and lower retainers 18U and 18L, respectively lock together to form a pocket to entrap the flat body 58 and in particular top stop portions 64 (see FIG. 44) of the terminal(s) 20 to be captured.

The locking connection between upper and lower retainers 18 occurs when lock arm members 80 on the upper retainer 18U snap into corresponding opening 82 in the seal 31 and opening 84 the lower retainer 18L. A pliable seal 31 (in the illustrated example embodiment of FIG. 21 made of, for example vinyl, but could be made of other types of polymers or rubber without departing from the spirit and scope of the present disclosure) is trapped between the two retainers 18U and 18L. This seal 31 is intended to minimize any leakage that could occur from the potting process and environmental contaminants.

The design of the switch assembly 10 as described below fixedly attaches the terminal members 20 into the retainer support 18 such that the final location for all switch assemblies during construction are constant and repeatable within the housing 12. The design of the retainer support 18 and terminal members 20, and their respective interconnection eliminate movement of the terminals and position of the terminal wipers 35 upon the contact and insulating rings 36, 38, respectively. This is further appreciated as the plunger 16 is translated between a lowered or engaged position and a raised or unengaged position (see FIG. 20).

The retainer support 18 is further provides enhanced reliability to the switch assembly 10 by the construct of first and second lock arms 80 (see FIG. 20) that passes through opening 82 in the seal 31 and opening 84 in the lower retainer 18 to engage a ledge 86 forming a locked connection 88 with the lower retainer 18L. The lock arms 80 are biased such that after passing through openings 82, 84, the spring outward from the plunger 14 in the direction of arrows A in FIG. 21, to form the locking connection 88.

The first and second lock arms 80A, 80B of the upper retainer 18U are transversely constructed, such that the geometrical design biases the base of the lock arms toward the outer region of the housing 12. This dual construct of the upper and lower retainer 18 advantageously allows the seal 31 to be positioned between the upper and lower retainers 18U, 18L, respectively within and surrounding the perimeter of the interior 90 of the housing 12, thus removing any leak paths to the internal components of the housing.

Figure 22:
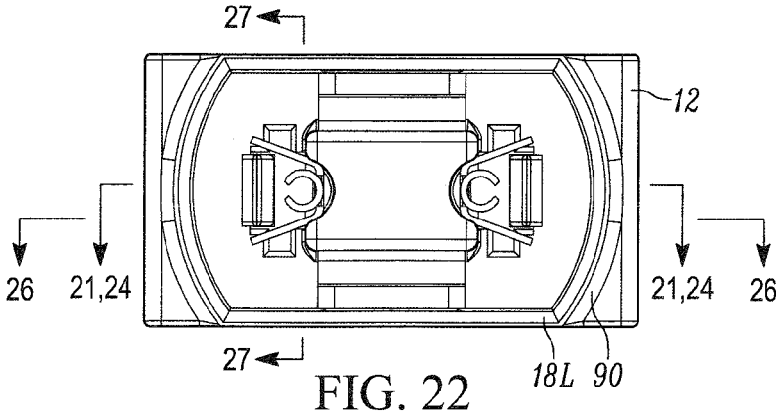
FIG. 22 is a bottom view of the switch assembly of FIG. 18.
Figure 23:
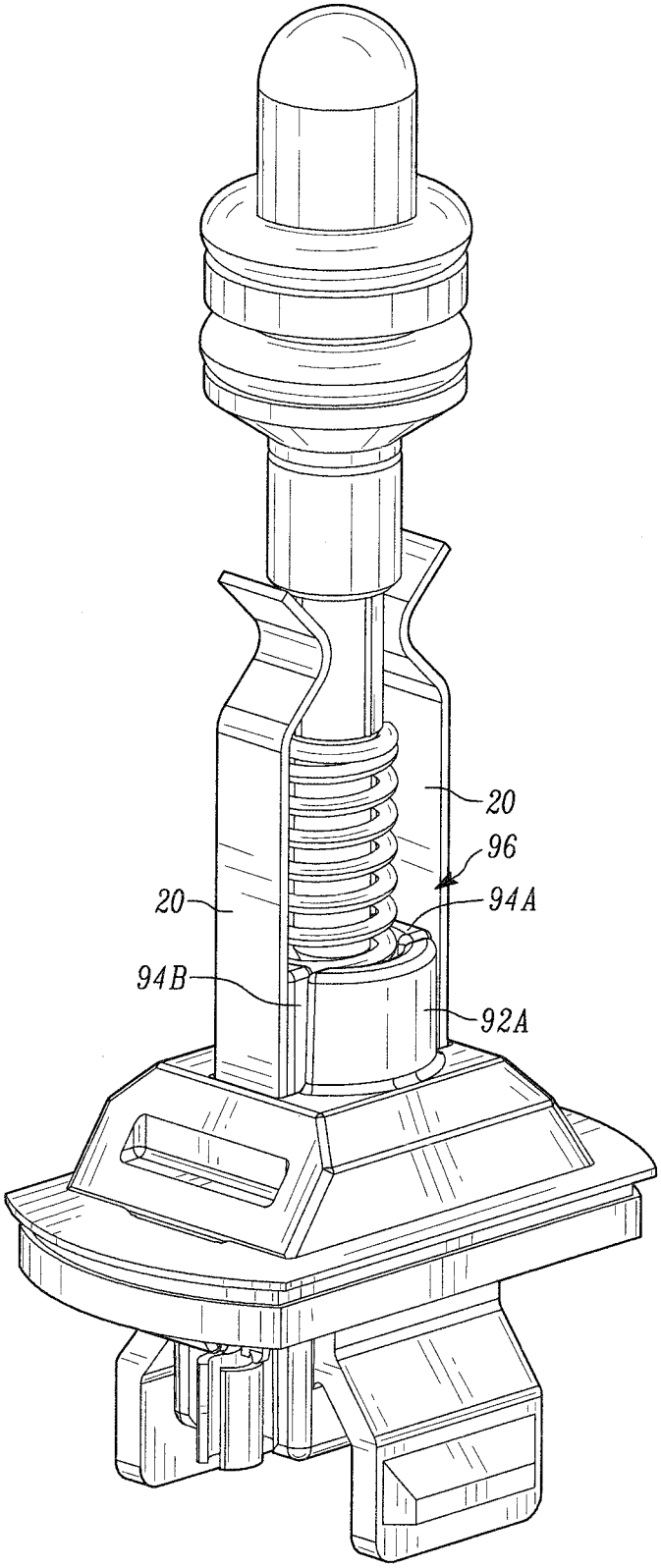
FIG. 23 is an assembly view of the switch assembly without a housing constructed in accordance with one example embodiment of the present disclosure.
Figure 24:
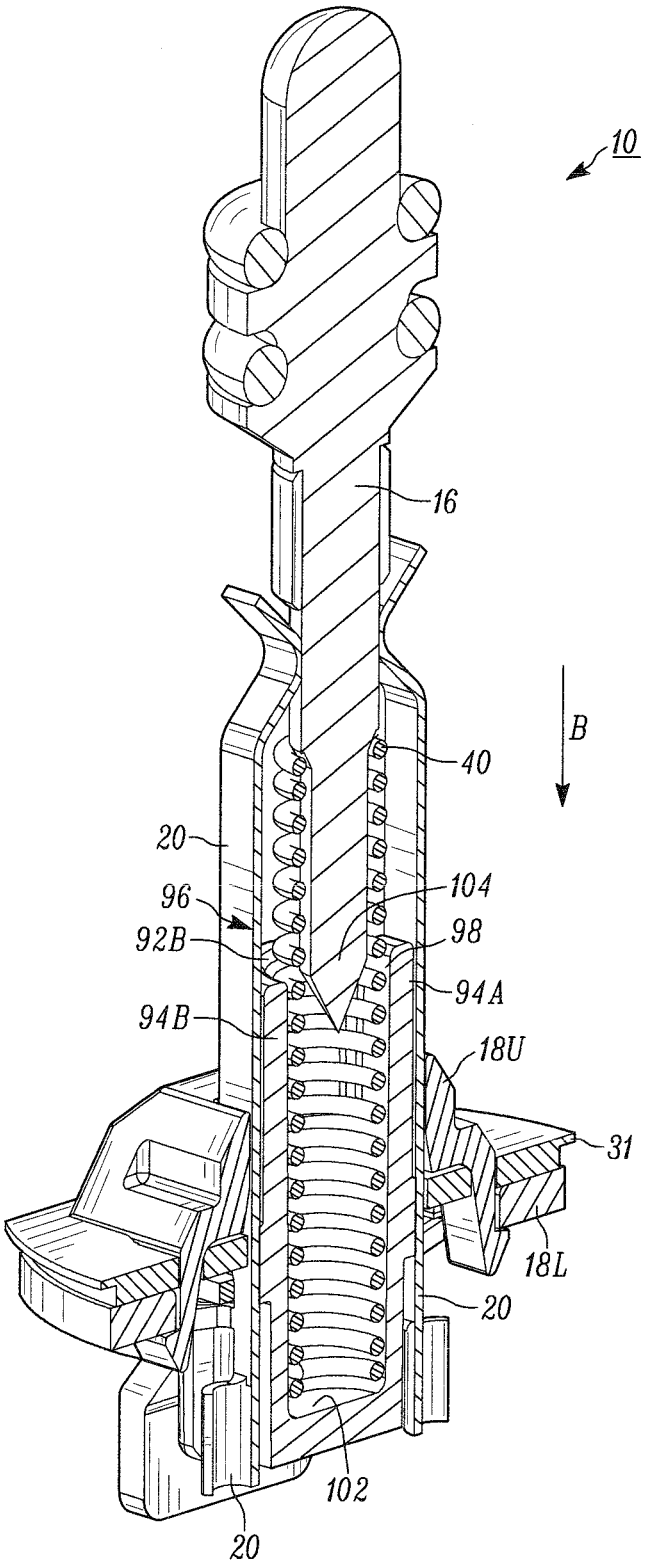
FIG. 24 is a section view of FIG. 22 without the housing 12.
Figure 25:
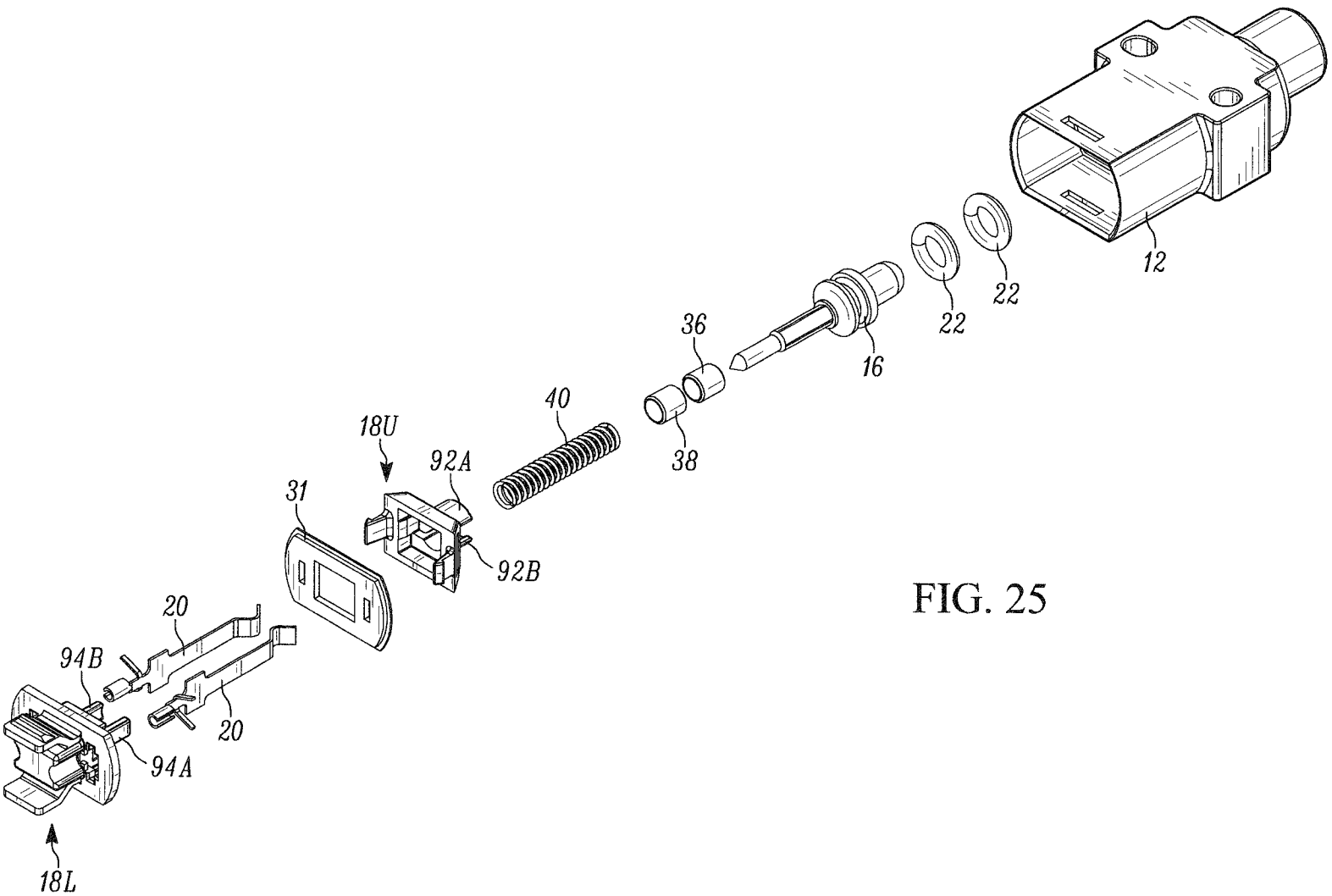
FIG. 25 is an exploded assembly view of FIG. 23 with the housing at the far end of the assembly.
Figure 26:
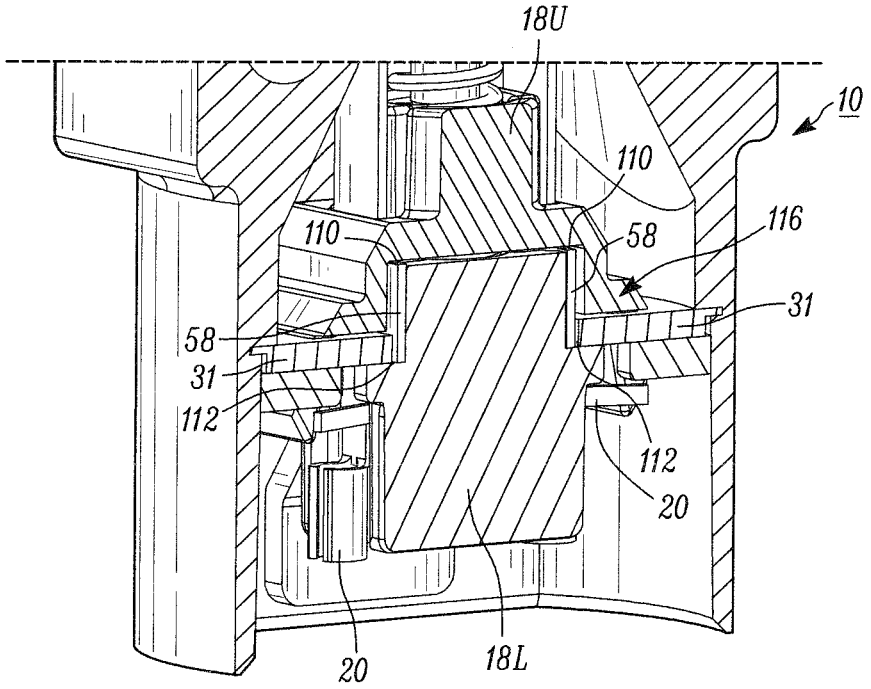
FIG. 26 is a section view of FIG. 22 along section lines 26-26.
Figure 27:
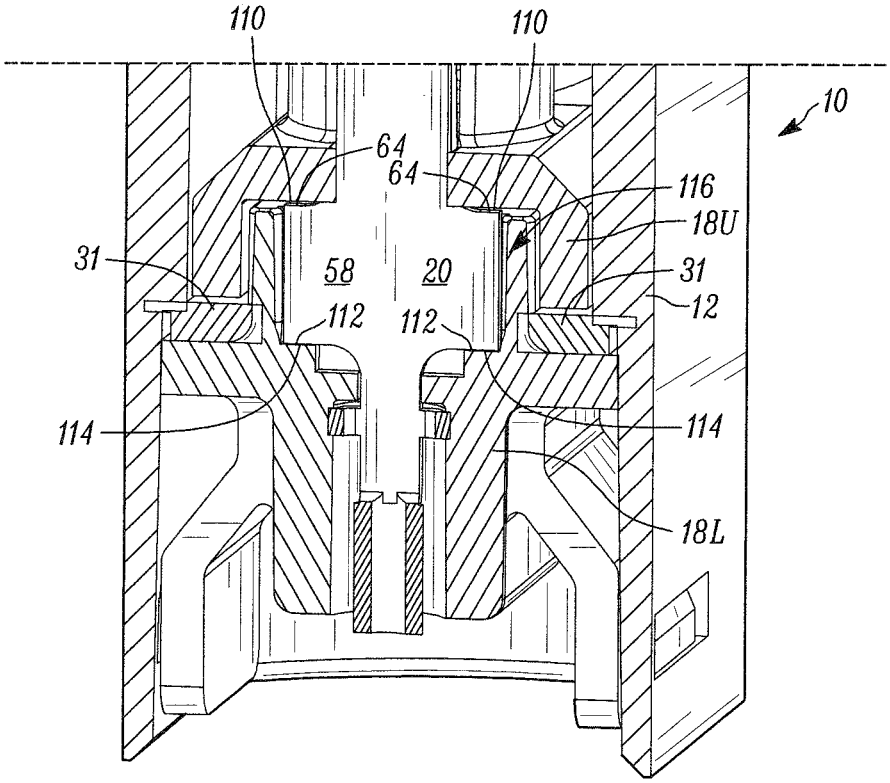
FIG. 27 is a section view of FIG. 22 along section lines 27-27.
Figure 28:
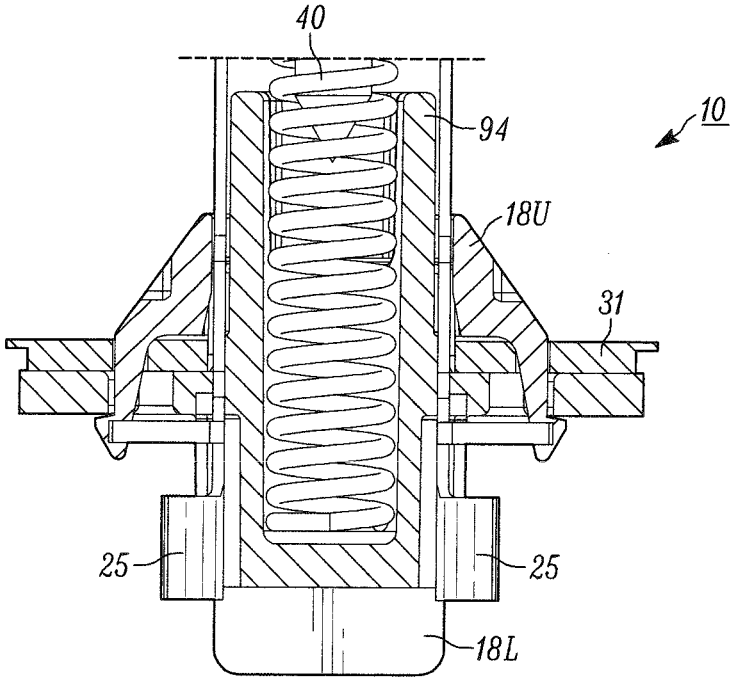
FIG. 28 is a section view of a retainer assembly in accordance with one example embodiment of the present disclosure.
Figure 29:
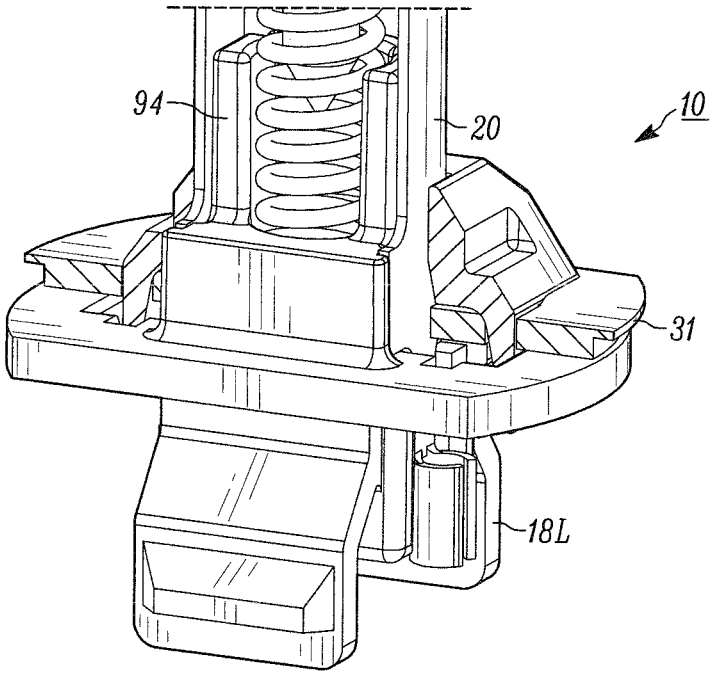
FIG. 29 is a section perspective view of the retainer assembly of FIG. 28.
Figure 30:
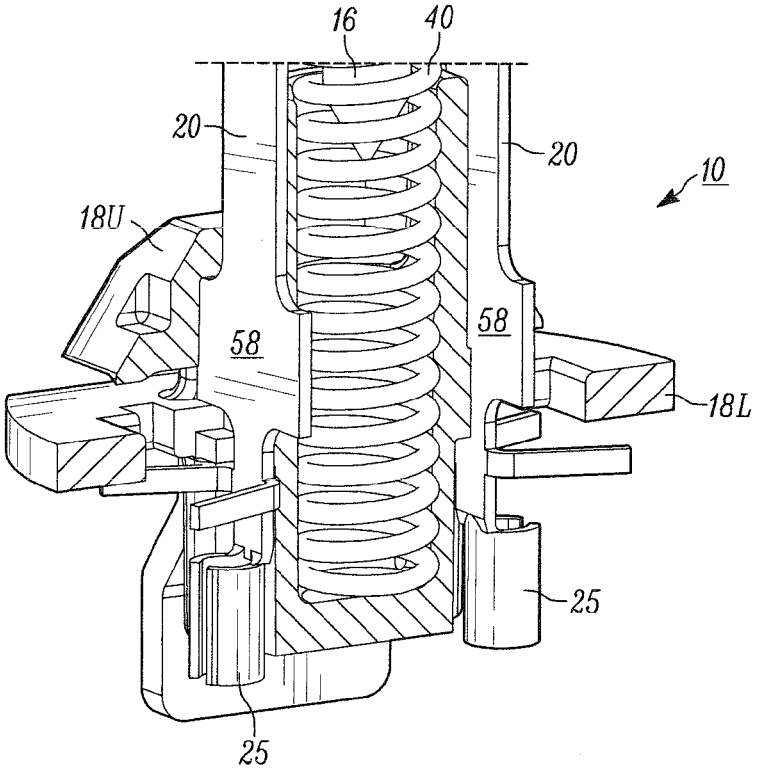
FIG. 30 is a partial assembly view of the retainer assembly in accordance with one example embodiment of the present disclosure.
Figure 31:
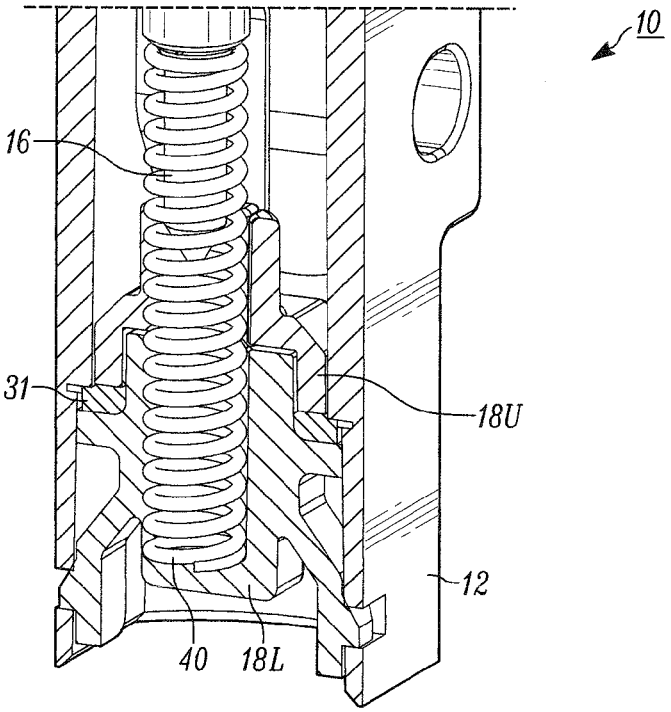
FIG. 31 is a partial assembly section view of the retainer assembly and housing in accordance with one example embodiment of the present disclosure.
Figure 32:
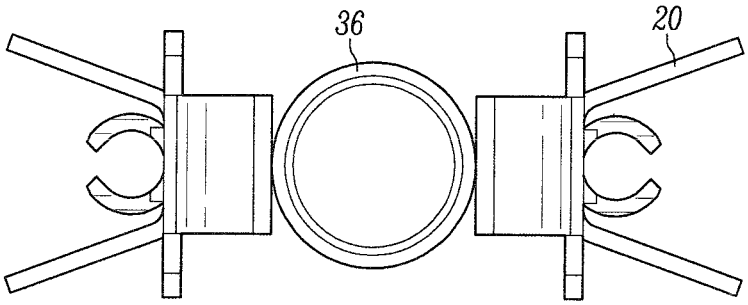
FIG. 32 is a top assembly view of the terminals in accordance with one example embodiment of the present disclosure.
Figure 33:
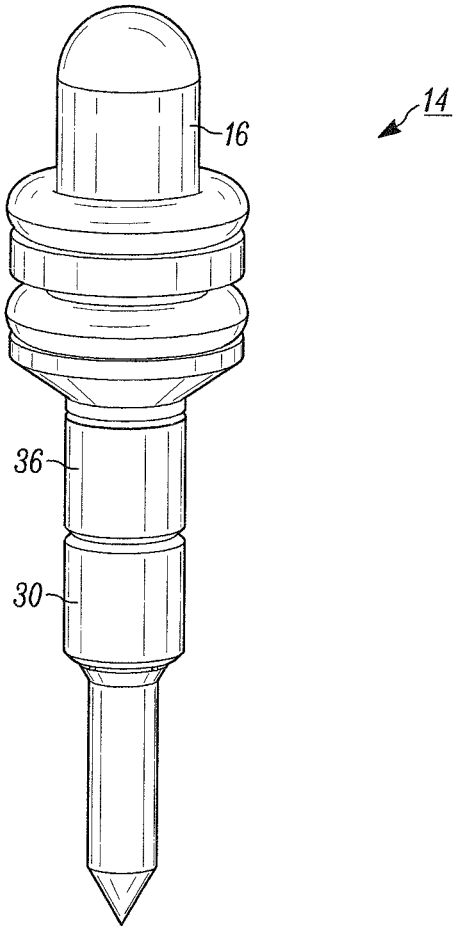
FIG. 33 is an elevation view of a plunger constructed in accordance with one example embodiment of the present disclosure.
Figure 34:
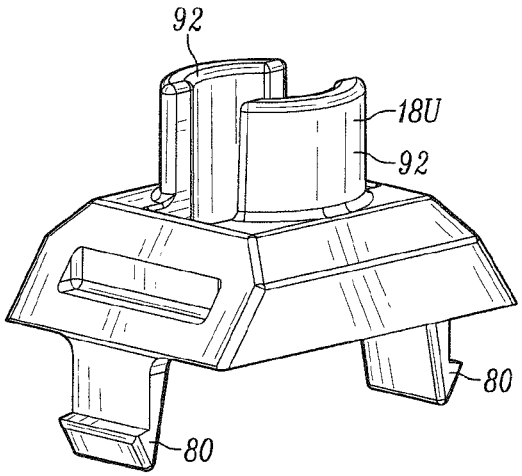
FIG. 34 is a perspective view of an upper retainer constructed in accordance with one example embodiment of the present disclosure.
Figure 35:
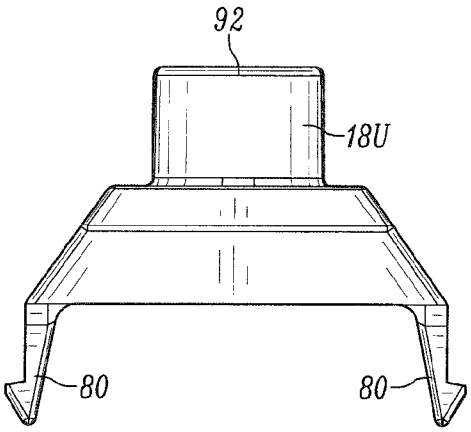
FIG. 35 is a elevation view of FIG. 34.
Figure 36:
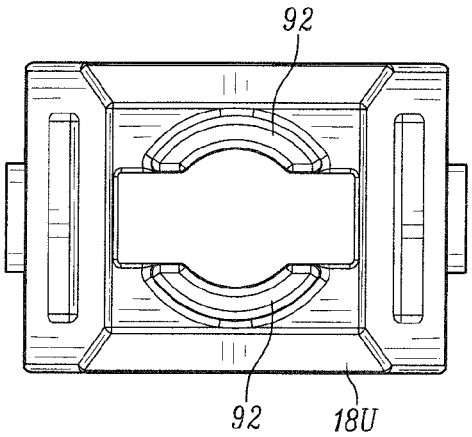
FIG. 36 is a top plan view of FIG. 34.
Figure 37:
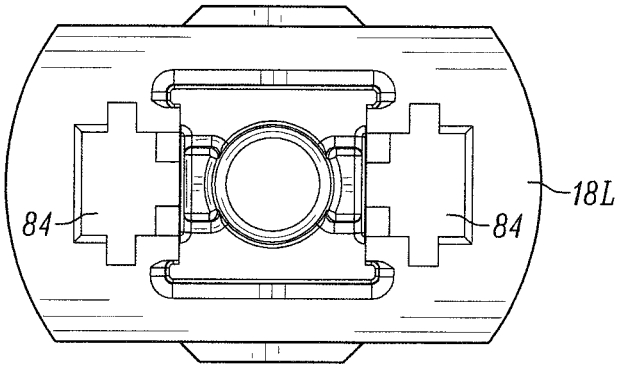
FIG. 37 is a top plan view of a lower retainer constructed in accordance with one example embodiment of the present disclosure.
Figure 38:
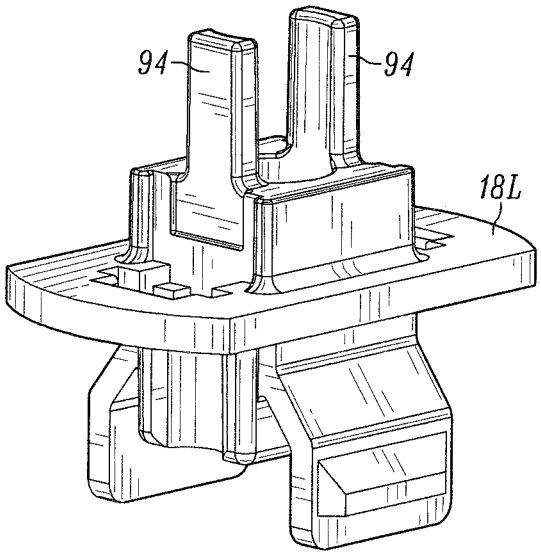
FIG. 38 is a perspective view of FIG. 37.
Figure 39:
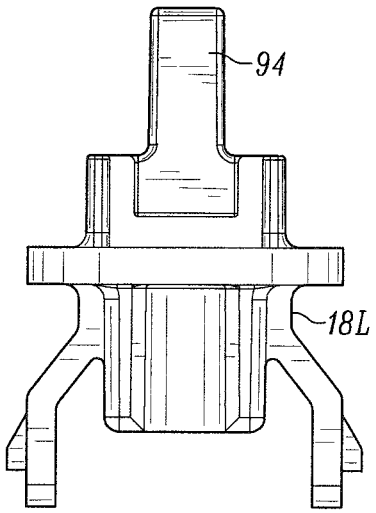
FIG. 39 is a side elevation view of FIG. 37.

The housing 12 interior perimeter 90 and its geometry locates and holds the retainer support 18, via the profile of the lower retainer 18L as illustrated in FIG. 22. The In the illustrated example embodiment of FIGS. 18-45, a semi-arcuate collar 92A and 92B projects upwardly from the upper retainer 18U and a semi-arcuate collar 94A and 94B projects upwardly from the lower retainer 18L through the upper retainer 18U to both collars 92 and 94 form a support channel 96.

The support channel 96 formed by the four equal-sized semi-arcuate collars 92A, 92B, 94A, and 94B generate a blind cylinder having an opening 98 that extends to blind base 102. The support channel 96 internally forms a cylinder that supports the spring member 40 and the inner movement of the plunger 16. The plunger 16 includes a tip portion 104 that remains within the support channel 96 when the plunger is in the most extended position (FIG. 24) and when the plunger 16 is compressed downward, as indicated in the direction of arrow B in FIG. 24.

The channel 96 and its receipt of the biasing member 40 advantageously support the plunger 16 as it moves within the housing 12. Moreover, the channel 96 formed by the raised two-piece retainer 18 semi-arcuate collars 92, 94 eliminates side movement of the spring 40 and plunger during operation, thus extending the life of the switch assembly 10. The four pieces forming the semi-arcuate collars 92, 94 and ultimately the support channel is illustrated in the exploded assembly view of FIG. 25 and in FIGS. 28-29, and 34-41.

Figure 42:
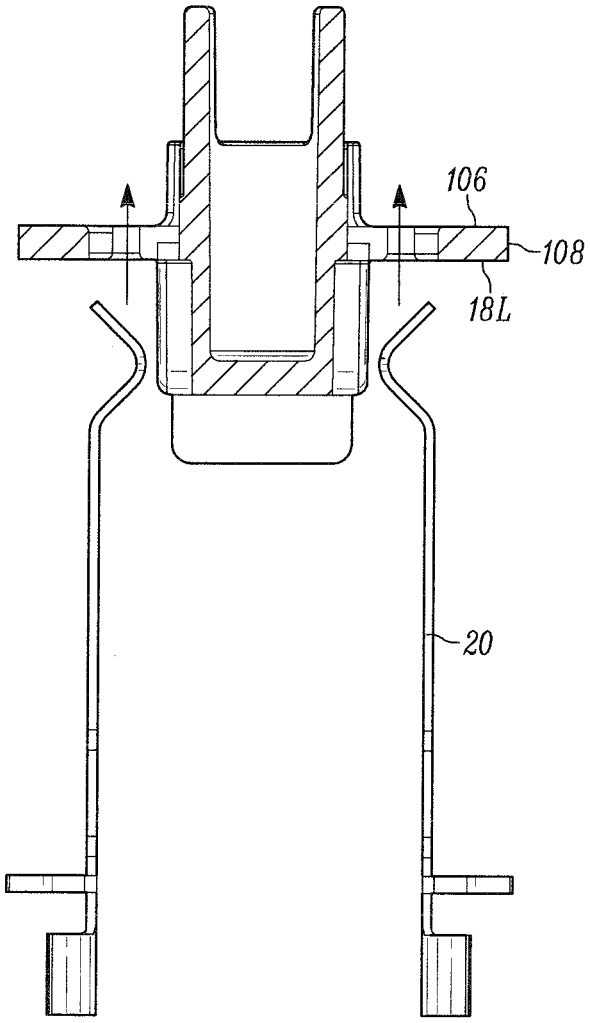
FIG. 42 is an assembly view of a lower retainer and terminals in accordance with one example embodiment of the present disclosure.
Figure 43:
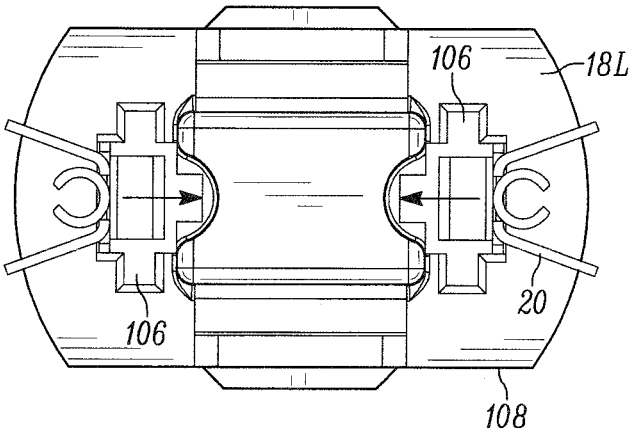
FIG. 43 is a top plan view of FIG. 42.
Figure 44:
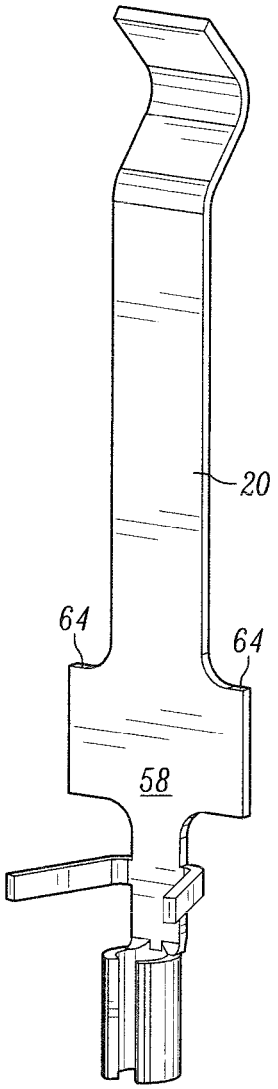
FIG. 44 is a perspective view of a terminal constructed in accordance with one example embodiment of the present disclosure.
Figure 45:
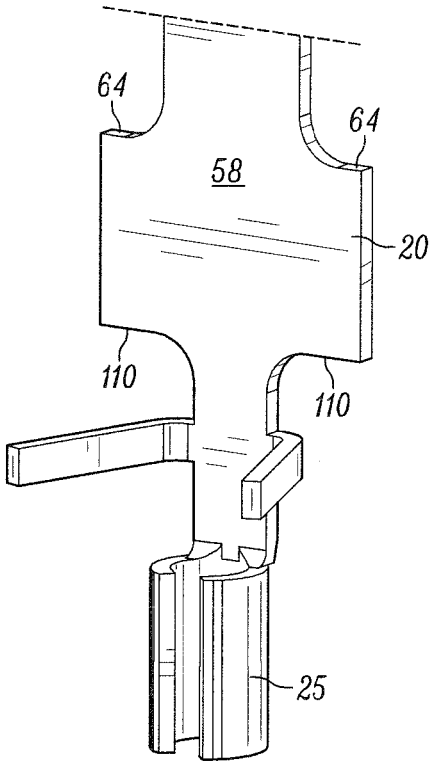
FIG. 45 is a magnified view of a portion of the terminal of FIG. 44.

The terminals 20 are positioned within the lower and upper retainers 18L, 18U, respectively. During assembly, the terminals are inserted through apertures 106 in extended flange 108 of the lower retainer 18L, as illustrated in FIGS. 42-44. The upper retainer 18U is then locked with the lower retainer 18L to nest the terminals 20 into position. In particular, the terminal body 58 is secured at its upper stops 64 by arms 18U illustrated in FIG. 27 and the body's lower stops 112 by shelves 114 of the lower retainer 18L.

As illustrated in FIGS. 26-31 and 45, the body 58 of the terminal member 20 or face of the terminal includes upper stops 64 and lower stops 110 closest to the crimp wings 25 are seated against the body of the lower retainer 18L. The flat seal 31 is then applied over the terminals. The upper terminal retainer 18U is then fed over the terminals 20 to capture and seat the terminals into position as the lock arm members 80 of the upper retainer 18U snap into the ledge of the lower retainer 18L. The upper face stops 64 of the body 58 of the wide features of the terminals is seated against the corresponding face or arms 110 of the upper retainer 18U. The two snap feature lock arms 80 on the upper retainer are locked into the openings 84 of the lower retainer. Nesting pockets 116 (see FIGS. 26-27) for the terminals are created once the upper and lower retainers are locked together. The nest features 116 formed by the upper and lower retainers 18U, 18L and their respective arms 110 and shelves 114 are intended to positively lock the terminals 20 into the correct position with respect to the plunger assembly 14. This example embodiment minimizes variation in the potting process, which will improve switch performance.

In one example embodiment, once the retainer support 18 is positioned and locked into the housing 12 a well 27 in the bottom of the housing receives a sealant such as epoxy that is poured into the housing. Historically, a vinyl seal is used to hold the terminals within the retainer. However, because of the retainer support 18 and terminal member 20 construct, the seal no longer functions as the support to the terminal members. This advantageously removes the variations in the location of the terminals and the human element that occurs during assembly. The seal 31 (see FIGS. 28-29) fixedly attaches between the upper and lower retainers 18U, 18L to create a seal connection within the retainer and around the terminals 20 from the outside elements. The two piece retainer support 18U and 18L eliminates the need for a vinyl seal used to hold terminals in earlier switches.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A switch assembly comprising:

a housing having a longitudinal axis for supporting a plunger for back and forth moveable positioning of the plunger relative to said housing along said longitudinal axis;

first and second elongated electrically conductive terminals supported within said housing wherein each of the first and second conductive terminals comprises a wiper portion positioned inside said housing, an external portion that extends outside said housing for coupling to an external circuit, and a locking portion located between the wiper portion and the external portion; and a terminal support for fixedly holding the first and second elongated electrically conductive terminals with respect to the housing, said terminal support comprising first and second terminal retainer grooves passing from a first end to a second end of the retainer support that position the terminals along a length of said grooves and further comprising first and second channels transverse to the grooves to position the locking portion of the conductive terminals while maintaining a gap between the wiper portion of said conductive terminals;

wherein the plunger includes exposed first and second surfaces which bridge the gap between said terminals wherein a first surface comprises a conductive material that electrically connects the terminals in a first plunger position and a second surface comprises an electrically insulating material that electrically isolates said terminals in a second plunger position.

2. The switch assembly of claim 1 wherein said first and second conductive terminals comprise a locking arm for securing the terminal within said terminal support.

3. The switch assembly of claim 2 wherein the terminal support comprises first and second portions and the locking arm of the first and second conductive terminals comprise a terminal body that seats within a channel of the terminal support wherein the terminal body comprises a first set of stops that engage the one portion of the terminal support and a second set of stops that engage a second portion of the terminal support.

4. The switch assembly of claim 1 wherein said plunger comprises a plunger body that supports contact member having at least one planar surface for the passage of electricity when engaged with said at least one terminal member.

5. The switch assembly of claim 1 wherein said plunger comprises a plunger body that supports an insulating member positioned upon said plunger body adjacent to said contact member.

6. The switch assembly of claim 1 further comprising a biasing member for biasing said plunger to a first position.

7. The switch assembly of claim 6 wherein said plunger comprises a plunger body supporting an insulating member and a electrically conductive member and wherein said biasing member is compressed upon an external force being applied to a head of said plunger such that said plunger translates from said first position to a second position such that the wiper portion of the terminals moves from engaging said insulating member to engagement with the electrically conductive member.

8. The switch assembly of claim 6 wherein said retainer support further comprises a recess for supporting an end of said biasing member.

9. The switch assembly of claim 5 wherein said insulating member has a corresponding number of planar surfaces engaged with planar surfaces of said contact member.

10. A switch assembly comprising:

a housing having a longitudinal axis for supporting a plunger for moveable positioning of a plunger relative to said housing along said longitudinal axis within a housing interior;

first and second elongated electrically conductive terminals supported within said housing wherein each of the first and second conductive terminals comprises a wiper portion positioned inside said housing interior, an external portion that extends outside said housing for coupling to an external circuit, and a locking arm located between the wiper portion and the external portion; and a two-piece terminal retainer support positioned within the housing interior having first and second terminal retainer support portions for fixedly holding the locking arms of said first and second elongated conductive terminals within a nesting pocket collectively formed by said retainer support portions.

11. The switch assembly of claim 10 wherein one of said terminal retainer support portions further comprises a lock arm member being received by an opening in the other of said terminal retainer support portions, the opening comprising a ledge engaged by said lock arm member to form a locking connection between said first and second terminal retainer support portions.

12. The switch assembly of claim 10 wherein one retainer support portion further comprises at least one semi-arcuate collar for supporting a portion of said plunger.

13. The switch assembly of claim 10 wherein said first and second terminal retainer support portions each comprise at least one semi-arcuate collar for supporting a portion of said plunger arrangement.

14. The switch assembly of claim 13 wherein said semi-arcuate collars of the first and second retainer support portions form an annular support channel for supporting a portion of said plunger arrangement.

15. The switch assembly of claim 10 wherein said terminals comprises a body having at least one shelf and at least one stop for engaging said nesting pocket formed by portions of both the first and second retainer support portions.

16. A switch assembly comprising:

a housing having a longitudinal axis for supporting a plunger arrangement for moveable positioning of a plunger relative to said housing and plunger arrangement along said longitudinal axis;

the plunger arrangement comprising a two-piece retainer support having an upper retainer support and lower retainer support, the upper and lower retainer support for fixedly holding at least one terminal member within a nesting pocket collectively formed by said upper and lower retainer supports;

wherein at least one of said upper retainer support and lower retainer support further comprises a lock arm member being received by an opening in the other of said upper retainer support and said lower retainer support, the opening comprising a ledge engaged by said lock arm member to form a locking connection between said upper retainer support and said lower retainer support; and an annular support channel is formed by semi-arcuate collars extending from said upper retainer support and said lower retainer support, the annular support channel for supporting at least a portion of said plunger arrangement.

17. The switch assembly of claim 16 wherein said terminal member comprises a body having at least one shelf and at least one stop for engaging said nesting pocket formed by portions of both the upper retainer support and said lower retainer support.

18. The switch assembly of claim 16 wherein said plunger arrangement further comprises a contact member having at least one planar surface for the passage of electricity when engaged with said at least one terminal member.

19. The switch assembly of claim 16 wherein said plunger arrangement further comprises an insulating member positioned upon said plunger adjacent to said contact member.

20. The switch assembly of claim 19 wherein said insulating member has a corresponding number of planar surfaces engaged with planar surfaces of said contact member.

21. A switch assembly comprising:

a housing having a longitudinal axis for supporting a plunger for back and forth moveable positioning of the plunger relative to said housing along said longitudinal axis;

first and second elongated electrically conductive terminals supported within said housing wherein each of the first and second conductive terminals comprises a wiper portion positioned inside said housing, an external portion that extends outside said housing for coupling to an external circuit, and a locking tang that extends outward from a generally planar intermediate portion of the terminals located between the wiper portion and the external portion;

a terminal support for fixedly holding the first and second elongated electrically conductive terminals with respect to the housing, said terminal support comprising first and second terminal retainer grooves passing from a first end to a second end of the retainer support that position the terminals along a length of said grooves and further comprising shelves that engage the locking tangs to position the locking tangs of the conductive terminals while maintaining a gap between the wiper portion of said conductive terminals;

wherein the plunger includes exposed first and second surfaces which bridge the gap between said terminals wherein a first surface comprises a conductive material that electrically connects the terminals in a first plunger position and a second surface comprises an electrically insulating material that electrically isolates said terminals in a second plunger position.

* * * * *